US006293652B1

(12) United States Patent
Arashima et al.

(10) Patent No.: US 6,293,652 B1
(45) **Date of Patent: *Sep. 25, 2001**

(54) METHOD FOR COUPLING LIQUID JET HEAD UNITS, A LIQUID JET HEAD UNIT, AND A LIQUID JET HEAD CARTRIDGE

(75) Inventors: Teruo Arashima; Kazuaki Masuda, both of Kawasaki; Junji Shimoda, Chigasaki; Hajime Yamamoto; Minoru Nozawa, both of Yokohama; Akihiro Yamanaka, Kawasaki; Eiichiro Shimizu, Urawa; Yasuo Kotaki, Yokohama; Jun Hinami, Kawasaki; Wataru Takahashi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 96 days.

(21) Appl. No.: 08/915,676

(22) Filed: Aug. 21, 1997

(30) Foreign Application Priority Data

| | | |
|---|---|---|
| Aug. 30, 1996 | (JP) | 8-229518 |
| Aug. 30, 1996 | (JP) | 8-230445 |
| Aug. 30, 1996 | (JP) | 8-230447 |
| Aug. 30, 1996 | (JP) | 8-230448 |
| Apr. 28, 1997 | (JP) | 9-111039 |

(51) Int. Cl.[7] ..... B41J 2/175
(52) U.S. Cl. ..... 347/49; 347/86; 347/101
(58) Field of Search ..... 347/20, 49, 50, 347/86, 40

(56) References Cited

U.S. PATENT DOCUMENTS

| | | |
|---|---|---|
| 4,803,499 | 2/1989 | Hayamizu . |
| 4,860,033 | 8/1989 | Shiozaki et al. . |
| 4,994,825 | 2/1991 | Saito et al. . |
| 5,095,321 | 3/1992 | Saito et al. . |
| 5,126,768 | 6/1992 | Nozawa et al. . |

(List continued on next page.)

FOREIGN PATENT DOCUMENTS

| | | | |
|---|---|---|---|
| 0 581 298 | 2/1994 | (EP) | B41J/2/175 |
| 0 659 573 | 6/1995 | (EP) | B41J/25/304 |
| 0 674 997 | 10/1995 | (EP) | B41J/2/175 |
| 0 701 900 | 3/1996 | (EP) | B41J/2/17 |
| 5-246044 | 9/1993 | (JP) | B41J/2/175 |
| 6-210869 | 8/1994 | (JP) | B41J/2/175 |

*Primary Examiner*—John Barlow, Jr.
*Assistant Examiner*—An Do
(74) *Attorney, Agent, or Firm*—Fitzpatrick, Cella, Harper & Scinto

(57) ABSTRACT

A method for coupling a liquid jet head unit is to couple a liquid jet head unit for recording by discharging liquid to a recording medium with a head installation member capable of installing the head unit through an elastic member. This method comprises the steps of preparing a liquid jet head unit structured integrally with two orifice arrays substantially paralleled and a first supply opening group for supplying liquid to the orifice arrays, and a head installation member provided with a second supply opening group corresponding to the first supply opening group for supplying liquid to the liquid jet head unit, and also, an elastic member having holes corresponding to each of the supply opening groups, providing first and second coupling units for one end side and the other end side of the two orifice arrays for coupling the liquid jet head unit and the head unit installation member, respectively and coupling only one face of the liquid jet head unit and the head unit installation member using the first and second coupling units. With the adoption of this method, it is possible to implement stabilized recording on a recording medium by a stabilized ink supply, at the same time, preventing any erroneous installation in the coupling mode.

35 Claims, 14 Drawing Sheets

U.S. PATENT DOCUMENTS

| | | | | |
|---|---|---|---|---|
| 5,208,604 | | 5/1993 | Watanabe et al. . | |
| 5,262,802 | | 11/1993 | Karita et al. . | |
| 5,347,713 | | 9/1994 | Shibata et al. . | |
| 5,361,087 | | 11/1994 | Tajima et al. . | |
| 5,389,957 | | 2/1995 | Kimura et al. . | |
| 5,450,110 | * | 9/1995 | Sato | 347/85 X |
| 5,485,184 | | 1/1996 | Nakagomi et al. . | |
| 5,512,926 | | 4/1996 | Uchikata et al. | 347/86 |
| 5,581,288 | | 12/1996 | Shimizu et al. | 347/87 |
| 5,602,576 | | 2/1997 | Murooka et al. . | |
| 5,604,523 | | 2/1997 | Tsukuda et al. | 347/86 |
| 5,652,608 | * | 7/1997 | Watanabe | 347/50 |
| 5,657,539 | | 8/1997 | Orikasa et al. . | |
| 5,805,190 | * | 9/1998 | Tsuchii | 347/101 X |
| 5,821,966 | * | 10/1998 | Schell | 347/86 |
| 5,874,971 | * | 2/1999 | Nishioka | 347/87 X |

* cited by examiner

METHOD FOR COUPLING LIQUID JET HEAD UNITS, A LIQUID JET HEAD UNIT, AND A LIQUID JET HEAD CARTRIDGE

BACKGROUND OF THE INVENTION

1. Field of the Invention

The present invention relates to the structure of attaching and detaching a liquid jet head cartridge to be used for a liquid jet recording apparatus. More particularly, the invention relates to the structure of attaching and detaching an exchangeable liquid jet head cartridge having a large capacity to retain a large amount of liquid or multiple color liquid. The invention also relates to a liquid jet head unit provided with such attaching and detaching structure, as well as to a liquid tank.

2. Related Background Art

Conventionally, the recording apparatus, which records on a recording medium, such as paper, cloth, plastic sheet, OHP sheet (hereinafter, simply referred to as a recording sheet), has been proposed to be in a mode in which the apparatus can mount a recording head of a wire dot type, a thermosensitive type, a thermal transfer type, or a liquid jet type.

Particularly, the liquid jet recording apparatus is utilized as output means of an information processing system, such as a printer serving as the output terminal of a copying machine, a facsimile, an electronic typewriter, a word processor, or a work station, or as a handy or portable printer provided for a personal computer, a host computer, an optical disk drive, a video equipment, or the like. The liquid jet recording apparatus is widely put on market.

Meanwhile, as energy generating devices that generate energy for discharging liquid from the discharge openings of a recording head, there are several types, such as using piezoelectric devices and other electromechanical transducing devices, means for irradiating laser or other electromagnetic waves for heat generation. These devices are utilized for discharging ink droplets. There is also a type that uses heat generating members having electrothermal transducing devices to heat liquid, among some others.

For the liquid jet recording apparatus, it is required to provide higher image quality, and to record in higher precision, because the modes that use multiply colored liquid/processing liquid are more in use. On the other hand, there are more demands on smaller apparatus.

As a result, an ink jet cartridge is in use, which is provided with the recording head unit and liquid container integrally formed for it. Also, there is a tendency to adopt the container mountable on such cartridge, which is formed integrally with plural liquid retainers, each having different kind of liquid at a time. For a cartridge of the kind, plural ink induction tubes are provided for the recording head unit so that it can discharge a plurality of different kinds of liquids. Also, as the mode of the recording head, there is the one in which plural arrays of orifices are arranged.

Meanwhile, a cartridge is structured integrally with a recording head unit and a holder arranged together with the head unit as one container which is made detachably mountable on such holder. In this case, the kinds of liquid retained in the container on one holder are plural. Here, however, the holder is utilized corresponding to the mode of use, such as a container being made removable for each color or for plural colors altogether at a time.

As a coupling mode of a recording head unit with respect to such container and holder capable of retaining plural kinds of liquids altogether, it is generally practiced in accordance with the conventional art that a sealant is simply applied in order to secure the airtightness of the supply unit, because a plurality of ink induction tubes are arranged in a close formation for the supply unit to be installed on the recording head unit.

On the other hand, as the coupling method of the recording head unit that uses a container retaining one kind of liquid, there is a fixing method of an easy disassembling type by means of a clicking system or the like, such as disclosed in the specification of Japanese Patent Application Laid-Open No. 6-210869, in addition to the structure that utilizes a sealant as described above.

Such coupling modes as described above are available at the level that satisfies the demands on the current market. However, with a view to dealing with the future development, the present inventors hereof have precisely studied the coupling modes of the recording head units and containers, and arrived at a conclusion that the following two aspects are important in meeting the requirements arising from the environmental problems that should be given more attention recently in particular, while maintaining the airtightness of the supply unit reliably.

One of them is that the number of the parts for the coupling portion should be smaller, and the parts themselves are simply structured. Then, it becomes possible to recycle each of the recording head unit and container/holder, respectively, or not only the recycling is made easier, but also, it contributes to making the recording apparatus smaller, not to mention the effect of the enhancement of production yield to follow, as well as the reduction of items to be taken up for executing quality control therefor.

The other one is that the recording head unit and container/holder are made detachably mountable or structured to be easily disassembled. When different parts should be coupled, the recycling capability and reusability of each part may be enhanced by making it possible to disassemble them easily.

When observing the conventional art from such viewpoints as described above, there are problems yet to be solved with respect to the recycling of resources, because the structure that should use sealant makes it impossible to separate the recording head unit and container/holder.

Also, if the conventional coupling mode that enables the easy disassembling is used as it is for the coupling unit of a recording head that is made capable of discharging plural kinds of different liquids, the recording head unit should become larger inevitably. Here, the problem is encountered that the numbers of parts are increased after all.

SUMMARY OF THE INVENTION

It is an object of the present invention to provide the coupling modes of recording head unit in consideration of the environmental problems, which contribute to solving the problems described above with respect to the cartridge having a recording unit capable of discharging plural kinds of different liquids without impeding the provision of a smaller apparatus, and to provide the coupling modes thereof to implement stable recording on a recording medium by effectuating stabilized ink supply. Relating to the provision of such coupling mode, various inventions are also described in the application hereof.

It is another object of the invention to provide the structure of preventing any erroneous mounting in performing such coupling modes, in addition to the objectives described above.

It is still another object of the invention to provide the coupling mode of recording head unit in addition to or independent of the objective described above, which makes it possible to maintain the surface of discharge openings at a constant position with respect to the head having a plurality of orifice arrays even when attachment and detachment thereof are repeated on the apparatus.

In accordance with the present invention, a method for coupling a liquid jet head unit to couple a liquid jet head unit for recording by discharging liquid to a recording medium with a head installation member capable of installing the head unit through an elastic member comprises the following steps of:

preparing a liquid jet head unit structured integrally with two orifice arrays substantially paralleled and a first supply opening group for supplying liquid to the orifice arrays, and a head installation member provided with a second supply opening group corresponding to the first supply opening group for supplying liquid to the liquid jet head unit, and also, an elastic member having holes corresponding to each of the supply opening groups;

providing first and second coupling units for one end side and the other end side of the two orifice arrays for coupling the liquid jet head unit and the head unit installation member, respectively; and coupling only one face of the liquid jet head unit and the head unit installation member using the first and second coupling units.

In this case, it may be possible to provide a step of arranging the first and second coupling units on a line passing between the two orifice arrays.

Also, it may be possible to provide a step of arranging each of supply opening groups for each of the orifice arrays in two lines substantially symmetrically between the two orifice arrays when observed from the installation surface.

In this case, it may be possible to provide a step of arranging the first and second coupling units on a line running beyond the two lines of supply opening groups.

Also, it may be possible to provide a step of arranging the first and second coupling units on the line running along the two lines of supply opening groups substantially parallel to them.

Also, it may be possible to provide a step of arranging the line passing the central portion of the two orifice arrays along the orifice array to be in agreement with the line passing the central portion of the two orifice arrays along the two lines of supply opening groups, and also, provide a step of arranging the first and second coupling units on such line.

In any one of the arrangements described above, it may be possible to provide a step of forming liquid supply flow paths partly by the elastic member, and also, a step of coupling the member to be in contact with liquid to be supplied.

Also, it may be possible to provide a step of using the supply opening group having means for positioning the elastic member as either one of the supply opening group of the first and second supply opening groups.

Also, it may be possible to provide a step of preparing the supply opening group having means for covering the circumference of the elastic member through a space as either one of the supply opening group of the first and second supply opening groups.

Also, it may be possible to provide a step of using an elastic sheet structured integrally with holes corresponding to the first and second supply opening groups as the elastic member.

Further, it may be possible to effectuate coupling by coupling means capable of being easily disassembled as a coupling unit.

In accordance with the present invention, a liquid jet head cartridge, which is coupled through an elastic member, comprises a liquid container for retaining liquid; a liquid jet head unit for recording by discharging the liquid to a recording medium; and a head installation member capable of installing the head unit.

This liquid jet head unit has together two orifice arrays substantially paralleled and a first supply opening group for supplying liquid to the orifice arrays;

the head installation member is provided with a second supply opening group corresponding to the first supply opening group for supplying liquid to the liquid jet head unit;

the elastic member has holes corresponding to each of the supply opening groups; and the first and second coupling units are provided for one end side and the other end side of the two orifice arrays for coupling the liquid jet head unit and the head unit installation member, respectively, and only one face of the liquid jet head unit and the head unit installation member is coupled by use of the first and second coupling units.

In this case, it may be possible to arrange the first and second coupling units on a line passing between the two orifice arrays.

Also, it may be possible to arrange the first and second coupling units on a line running along the two orifice arrays substantially parallel to them.

Also, it may be possible to arrange each of supply opening groups for each of the orifice arrays in two lines substantially symmetrically between the two orifice arrays when observed from the installation surface.

In this case, it may be possible to arrange the first and second coupling units on a line passing between the two orifice arrays.

Also, it may be possible to arrange the first and second coupling units on a line running along the two orifice arrays substantially parallel to them.

Also, it may be possible to arrange the line passing the central portion of the two orifice arrays along the orifice array to be in agreement with the line passing the central portion of the two orifice arrays along the two lines of supply opening groups, and also, arrange the first and second coupling units on such line.

Also, it may be possible to form liquid supply flow paths partly by the elastic member, and arrange the member is in contact with liquid to be supplied.

Also, it may be possible to form the surface of either one of the first and second supply opening groups that abuts upon the elastic member to be flat, and to configure at least two of the other supply opening groups to be extrusions being inserted into the holes formed on the elastic member.

Also, it may be possible to provide either one of the first and second supply opening groups with a side wall covering the circumference of the elastic member through a space.

Also, it may be possible to structure the elastic member integrally with holes corresponding to the first and second supply opening groups.

Also, it may be possible to arrange the coupling unit to be coupled by coupling means capable of being easily disassembled.

Also, it may be possible to provide a positioning mechanism for the installation surface of the liquid jet head unit and head unit installation member.

Also, it may be possible to enable the positioning mechanism to dually serves as a mechanism to prevent erroneous installation with respect to the direction of installation.

Also, it may be possible to arrange one of the orifice arrays to discharge processing liquid for use of image quality enhancement, and the other array to discharge ink.

Also, it may be possible to arrange a groove between the supply opening to supply processing liquid and the supply opening of the second supply opening groups to supply ink.

Also, it may be possible to arrange one array of the orifice arrays to discharge ink having darker density, and the other array to discharge ink having lighter density.

Also, it may be possible to arrange one array of the orifice arrays to be a dummy orifice array for performing no actual discharge.

Also, it may be possible to arrange the supply opening groups to be formed by the supply openings that supply liquid actually and the dummy supply openings that do not supply any liquid actually.

Also, it may be possible to structure the liquid container and the head unit installation member integrally.

Further, it may be possible to structure the ink tank having the liquid container and the head holder having the head unit installation member individually to be separable.

In accordance with the present invention, a liquid jet head unit is used for a method for coupling a liquid jet head unit described above, in which a substrate having resistive heat generating devices formed thereon to discharge ink individually corresponding at least to one array of the two orifice arrays is, in the state of being adhesively bonded to a metallic base, pressed to be fixed to a ceiling plate having a plurality of ink flow path grooves, ink chambers, and ink induction paths formed thereon and a plurality of orifice arrays being arranged in two arrays substantially paralleled therefor, and the circumference thereof is airtightly closed by sealant to form ink flow paths and ink chambers, while a flexible wiring substrate having connection pads thereon for making electrical connection with the carriage side is connected with the substrate, and the wiring substrate is fixed to the metallic base and the ceiling plate.

In this respect, the term "liquid tank" used for the description given below is the one that retains recording liquid besides ink, such as processing liquid to be used for the enhancement of image quality.

BRIEF DESCRIPTION OF THE DRAWINGS

FIG. 2A is a plan view showing the installation surface of the liquid tank 22 of the liquid jet head unit 10;

FIG. 2B, a plan view showing the liquid jet unit 10, observed in the direction of its upper surface when it is installed; and FIG. 2C, a plan view showing the state of the installation thereof.

FIGS. 7A, 7B, 7C and 7D are cross-sectional views, taken in the direction that couples two installation screws; and FIGS. 7E, 7F, 7G and 7H, cross-sectional view, taken in the direction perpendicular to the direction in which the two installation screws are coupled.

FIG. 9A is a plan view thereof, observed from the side of the installation surface of the liquid tank;

FIGS. 9B and 9C are cross-sectional views, taken along line 9B—9B, and line 9C—9C, respectively; and FIG. 9D, a cross-sectional view showing the coupling state.

FIGS. 16A and 16B are the plan view and cross-sectional view showing the state of installation, respectively; and FIGS. 16C and 16F, 16D and 16G, and 16E are cross-sectional views which illustrate still other embodiments, respectively.

DETAILED DESCRIPTION OF THE PREFERRED EMBODIMENTS

Hereinafter, with reference to the accompanying drawings, the description will be made of the embodiments in accordance with the present invention.

Embodiment 1

Figure 1:
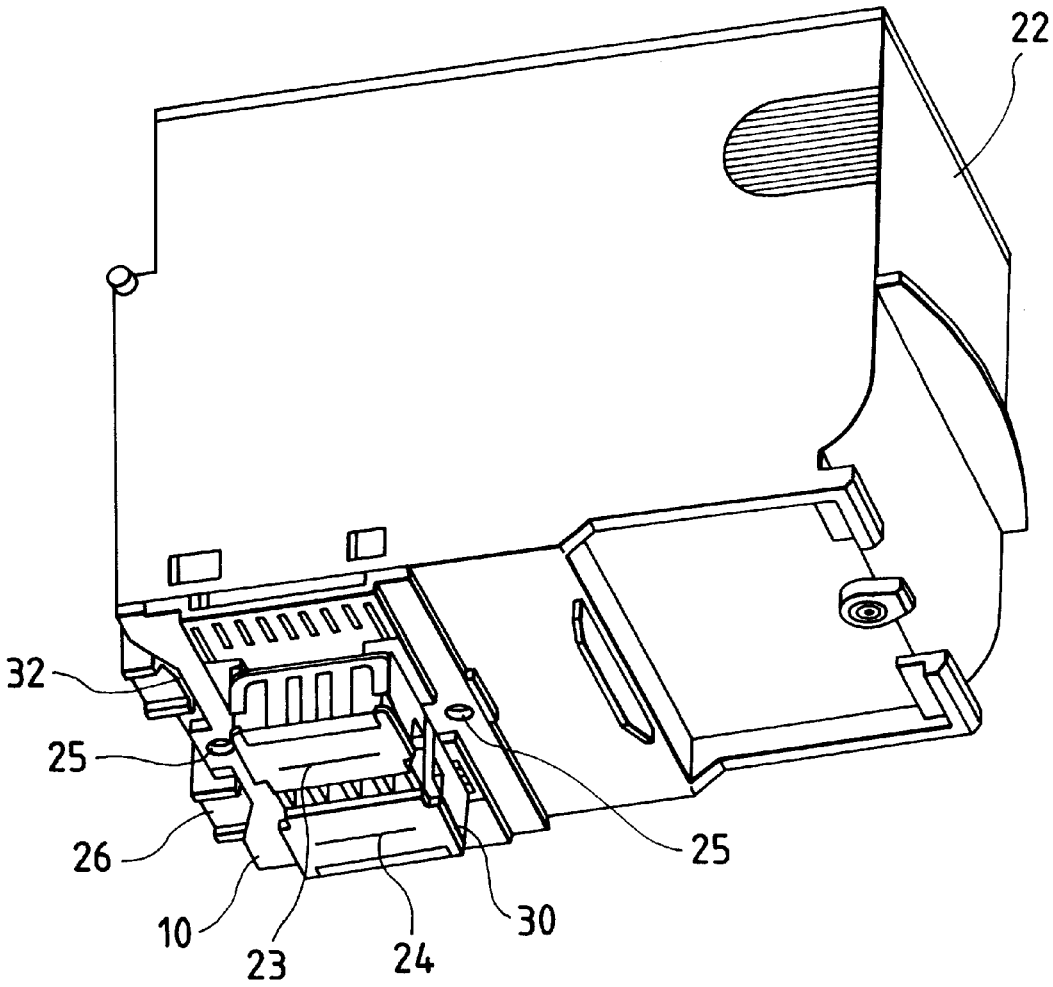
FIG. 1 is a perspective view which shows the structure in accordance with a first embodiment of the present invention.

FIG. 1 is a perspective view which shows the structure of a first embodiment in accordance with the present invention. For the present embodiment, a liquid tank 22 is provided with a head installation unit. The liquid jet head unit 10 is directly mounted on such head installation unit. The liquid tank 22 has the liquid containers (not shown) in it to retain black (Bk) ink and image quality enhancement liquid. For the liquid jet head unit 10, a discharge chip 30 is arranged with the orifice array 23 for discharging image quality enhancement liquid and the orifice array 24 for Bk ink discharge.

The liquid jet head unit 10 of the present embodiment is coupled with the liquid tank 22 by means of screws fit for the liquid tank 22 through threaded holes 25, which makes its installation and removal easier. Also, as shown in FIG. 1, the installation surface of the liquid jet head unit 10 to the liquid tank 22 is made one side (bottom side). With this arrangement, the processing configuration of the liquid tank 22 and the liquid jet head unit 10 are made simpler for easier manufacture thereof. For each of the liquid tank 22 and the liquid jet head unit 10, there are arranged the positioning extrusion (convex) 26 and the recessed portion (concave) 26 configured to fit with the positioning extrusion 26, respectively, in order to regulate the direction of installation when the liquid jet head unit 10 is mounted. With the structure thus arranged, the liquid jet head unit is mounted only in the regular position.

Figure 2A:
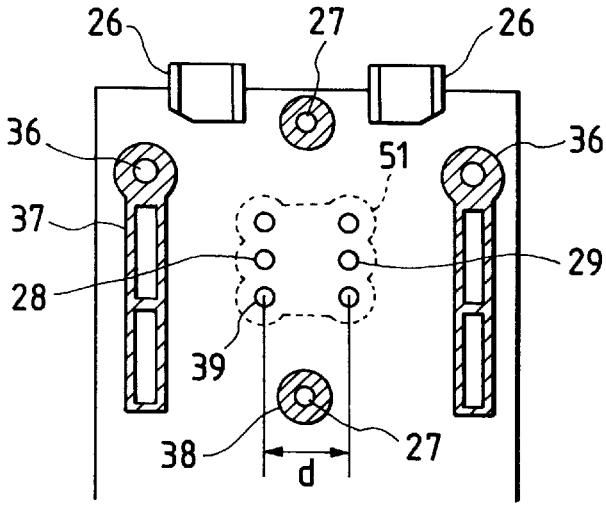
FIGS. 2A, 2B, and 2C are the plan views which illustrate the state where the liquid jet head unit 10 shown in FIG. 1 is installed.
Figure 2B:
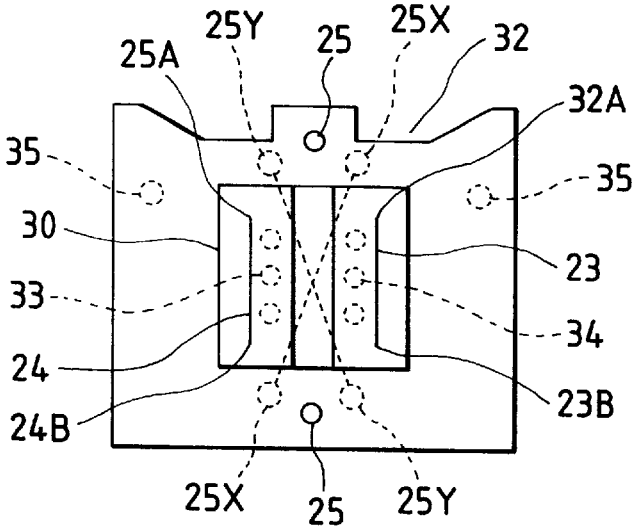
Figure 2C:
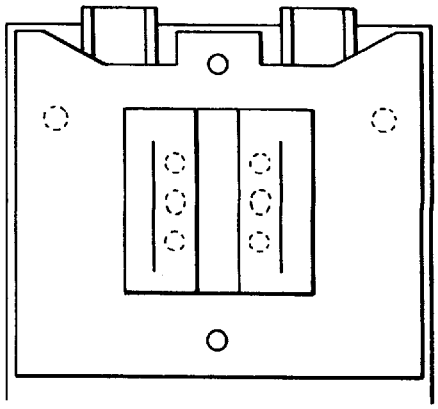

FIGS. 2A to 2C are the plan views which illustrate the state where the liquid jet head unit 10 is installed. FIG. 2A is a plan view showing the installation surface of the liquid tank 22 of the liquid jet head unit 10. FIG. 2B is a plan view showing the liquid jet unit 10, observed from above in the direction of its upper surface when it is installed. FIG. 2C is a plan view showing the state of the installation thereof.

For the liquid tank 22, two threaded holes are arranged to install the liquid jet head unit 10. The Bk ink supply opening 28 and the image quality enhancement liquid supply opening 29 are provided for supplying Bk ink and image quality enhancement liquid, respectively. For the Bk ink supply opening 33 and the image quality enhancement liquid supply opening 34, dummy supply openings 39 are arranged adjacent to them in the same configuration, respectively. Therefore, six supply openings are provided in total. In the positions on the liquid jet head unit 10 corresponding to these holes, there are arranged two threaded holes 25, the Bk ink supply opening 33 and image quality enhancement liquid supply opening 34, each for supplying Bk ink and image quality enhancement liquid, and four dummy supply openings 40, respectively.

As clear from FIGS. 2A to 2C, each of the supply opening groups for the liquid jet head unit and liquid tank is present together between two orifice arrays 23 and 24 when observed from above the installation surface. The arrangement thereof is substantially axial symmetry to the line passing the central part of the orifice arrays. As a result, these supply openings are arranged in two lines substantially in parallel with the orifices. The gap between two arrays of orifices is approximately 15 mm in accordance with the present embodiment. The distance d between the centers of two lines of supply openings is approximately 6 mm in accordance with the present embodiment. It is desirable to set the distance d shorter than the gap between the two arrays of orifices. The preferable range of d applicable to the field of ink jet recording is approximately 3 to 20 mm.

As shown in FIG. 2B, in accordance with the present embodiment, a first coupling portion is arranged on one end 23A and 24A side of the Bk ink orifice array and the image quality enhancement orifice array, and on the other end 23B and 24B side, a second coupling portion is arranged as the respective coupling units by means of threaded holes 25 and screws 25 (not shown). Here, it should be good enough if only the first and second coupling units are arranged on end side and the other end side of the two orifice arrays, respectively. In this respect, as the positions of the first and second coupling units, it may be possible to set them in the locations at 25X and 25Y in FIG. 2B. Particularly, it is desirable to provided the first and second coupling units on the line passing between the two orifice arrays. Further, as shown in the present embodiment, it is possible to realize the coupling more reliably if the threaded holes 25 are arranged on the line which is axially symmetrical to the two orifice arrays and the supply opening groups. It is of course possible to provide some auxiliary means for fixing the members further in some other locations without any problem if only fixed on the two coupling locations as described above. Here, in accordance with the present embodiment, approximately 300 nozzles are provided for each of the orifice arrays.

Also, for positioning use at the time of installation, two engagement holes 36 are provided for the liquid tank 22. Also, for the liquid jet head unit 10, two extrusions 35 are arranged in the configuration fit for these two engagement holes 36 in the positions corresponding thereto. Each of the circumferences of the two engagement holes 36 and threaded holes 27 is made to be a mount 37 and a mount 38 with a given height to the surface of the installation surface, respectively. When being installed, therefore, the liquid jet head unit 10 abuts upon the mounts 37 and 38 so that the gap between the liquid tank 22 and the liquid jet heat unit 10 is kept in the given height as described above.

Here, in accordance with the present embodiment, each of the supply openings is coupled through an elastic coupling member (sealing member) as indicated by broken line in FIG. 2A. However, irrespective of the length of the elastic members in the coupling direction, the installation surface between the head unit and liquid tank is positioned in the height direction at a given height determined by the mounts 37 and 38 described above. Here, the elastic coupling members will be described later.

Bk ink retained in the liquid tank 22 is supplied to the discharge chip 30 through the Bk ink supply openings 28 and 33, and discharged from the Bk ink orifice array 24. Image quality enhancement liquid is supplied to the discharge chip 30 through the image quality enhancement liquid supply openings 29 and 34, and discharge from the image quality enhancement orifice array 23.

Now, the description will be made of the directional regulation of installation in accordance with the present embodiment. Two threaded holes 25 are arranged for the liquid jet head unit 10. On the side in the vicinity of one of them, two recesses 26 are formed by being cut off in the direction toward the interior of the liquid jet head unit 10, with the threaded hole 25 being arranged between them. Also, on the portion 32 of the liquid tank 22 corresponding to the two recesses, the positioning extrusions 26 are arranged to protrude toward the liquid jet head unit 10. In this way, the liquid jet head unit 10 can be installed on the liquid tank 22 only in the positional relationship shown in FIG. 1 and FIGS. 2A to 2C. If it should be intended to install the liquid jet head unit 10 in the reverse direction, that is, if it is being installed in the state rotated 180 degrees from the state shown in FIG. 1 and FIGS. 2A to 2C, the positioning extrusion 26 abuts upon the side in the vicinity of the other threaded hole 25. Therefore, the head unit cannot be installed in this manner.

With the present embodiment structured as described above, the Bk ink supply opening 28 is prevented from being connected with the image quality enhancement liquid supply opening of the liquid jet head unit 10, hence making a reliable liquid supply possible.

In this respect, the Bk ink orifice array 24 and the image quality enhancement orifice array 23 are formed to be symmetrical to the line that connects the two threaded holes when observed from above as in FIGS. 2A to 2C. This arrangement is made in consideration of the combination with a liquid tank that is not provided with any structure to regulate such installation direction as described above. With the structure thus arranged, it becomes possible to combine even with a liquid tank that should be installed in the reverse direction. In this manner, the kinds of liquid tanks that may be combined increase.

Also, if the screw fixation is positioned by two points, the object tends to rotate linearly with respect to the two points. Particularly, if the fixation is made at two points in the position orthogonal to the arrangement direction of orifice array, there is a possibility that the distance between a recording sheet and the nozzle array becomes different at one end of the orifice array and at the other end thereof. On the other hand, in accordance with the present embodiment, the line connecting the fixing points is substantially parallel with the arrangement direction of the image quality enhancement orifice array 23 and the Bk ink orifice array 24, which are arranged substantially parallel to each other. Consequently, it is possible to obtain the better results of recording without any fear that such problem as described above is encountered.

Also, since the positions of the Bk ink supply openings 28 and 33, and the image quality enhancement liquid supply openings 29 and 34 are arranged to be axially symmetrical to the line that connects the two threaded holes, pressure is efficiently transferred to each of the supply openings when the screws are tightened. With this arrangement, it is possible to supply liquid reliably in accordance with the present embodiment.

Now, in accordance with the present embodiment, the description will be made of coupling of each of the supply openings of the liquid tank 22 with the liquid jet head unit 10 using the coupling member described above.

Figure 3:
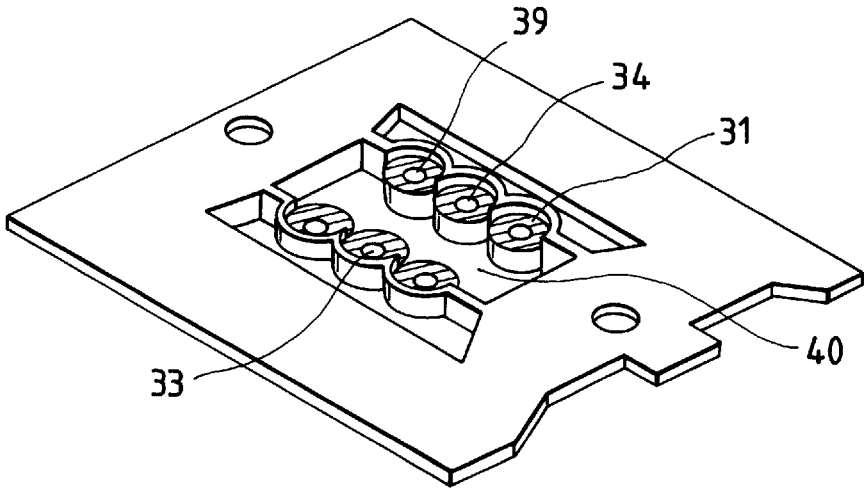
FIG. 3 is a perspective view which shows the liquid jet head unit 10 represented in FIG. 1, observed from its installation side.

FIG. 3 is a perspective view which shows the liquid jet head unit, observed from the side of its installation surface. Each of the Bk ink supply opening 37, image quality enhancement liquid supply opening 38, and four dummy supply openings 39 are positioned so that the upper surface positions thereof are away by a given distance from the installation surface. The recessed portion is formed in this way. Also, the upper surface where the supply openings are released is separated for the Bk ink supply opening 37 and the image quality enhancement liquid supply opening 38 including the respective dummy supply openings 39 adjacent to them, and between the separated surface, a groove 40 is formed. As a result, if ink or liquid should leak for some reasons, such leakage is retained in this groove 40 arranged in the interior of the recessed portion. There is no possibility that ink and liquid are mixed on the coupling surface 31. Color mixture resulting from such mixture of ink and liquid is also prevented by means of supply openings independently formed. In accordance with the present embodiment, it is attempted to prevent colors from being mixed on either coupling surfaces of the liquid jet head unit 10 and the liquid tank 22.

Figure 4:
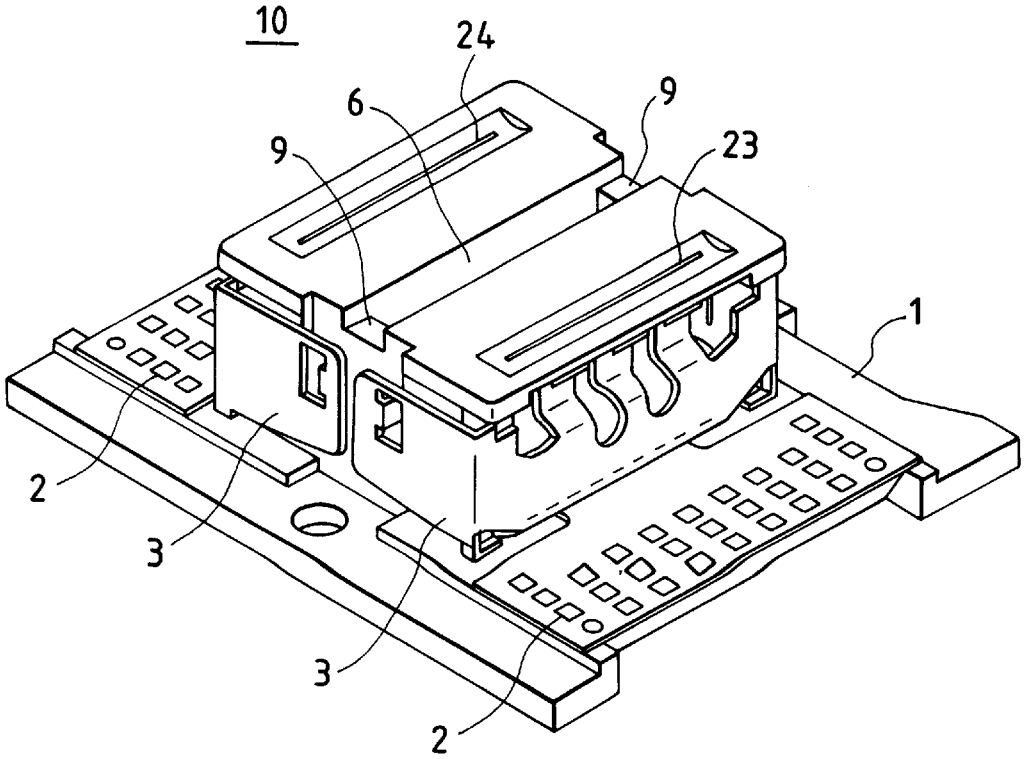
FIG. 4 is a perspective view which schematically shows the structure of the liquid jet head unit 10.

FIG. 4 is a perspective view which schematically shows the structure of the liquid jet head unit 10 of the present embodiment (two arrays of ink discharge openings are arranged in accordance with the present embodiment). In FIG. 4, a reference numeral 1 designates a ceiling plate where liquid flow path grooves, liquid chamber, and orifice arrays are provided; 2, a wringing substrate that connects the substrate for use of resistive heat generating members with the carriage side electrically; 3, an elastic member that presses and fixes the substrate 2 for use of the resistive heat generating members to the ceiling plate 1; 23 and 24, the image quality enhancement orifice array and Bk ink orifice array, which are open on the ceiling plate 1 to discharge image quality enhancement liquid and Bk ink, respectively; 6, a recessed portion arranged to prevent liquids from being mixed when discharged from the image quality enhancement orifice array 23 and Bk ink orifice array 24; and 9, ribs arranged for the recessed portion 6.

Figure 5:
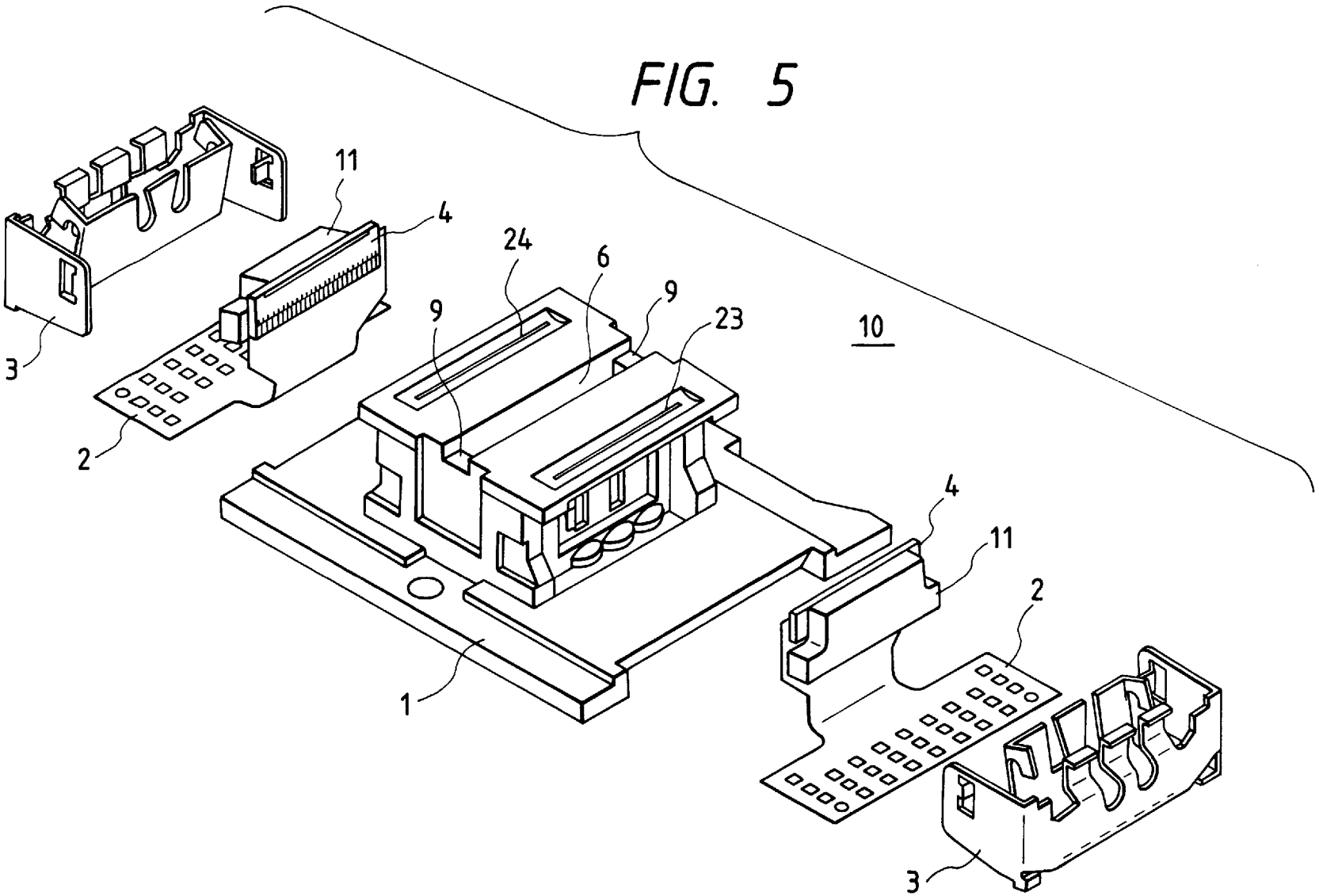
FIG. 5 is an exploded perspective view which shows the details of the structure of the liquid jet head unit 10 represented in FIG. 4.

The structure of the two-array arrangement of the present embodiment makes it easier to produce the ceiling plate as compared with the structure having three arrays or more, because the second array can be manufactured symmetrically with respect to the first array. This structure also makes it easier to assemble them. FIG. 5 is an exploded perspective view which shows the details of the liquid jet head unit 10 represented in FIG. 4, which schematically illustrates the outline of structural parts and the assembling thereof for easier understanding. In FIG. 5, a reference numeral 4 designates the substrate including the resistive heat generating devices, which is connected with the wiring substrate 2 electrically by means of TAB (tape automated bonding) assembling.

Further, the wiring substrate 2 is fixed to a metallic base 6 by means of adhesive bonding so that no bending force affects the substrate 4 for use of the resistive heat generating devices when the wiring substrate 2 is folded.

Figure 6:
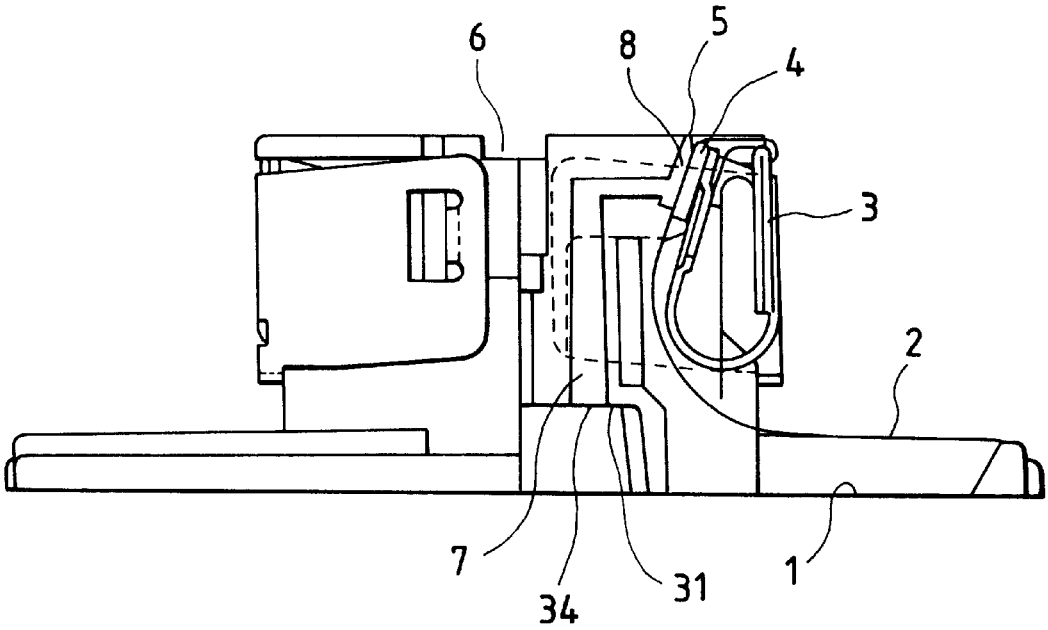
FIG. 6 is a cross-sectional view which shows the outline of the inner structure of the liquid jet head unit 10 represented in FIG. 4 and the liquid paths for easier understanding.

Also, FIG. 6 is a cross-sectional view which shows the outline of the inner structure of the liquid jet head unit 10 represented in FIG. 4 and the ink path for easier understanding.

In FIG. 6, a reference numeral 7 designates the ink induction path that induces image quality enhancement liquid from its container. From the tank 22, liquid flows in the liquid chamber 8, which is formed the ceiling plate 1 and the substrate 4 for use of resistive heat generating devices, through the image quality enhancement liquid supply openings 29 and 34, and flows further from the liquid chamber 8 into the liquid flow paths having resistive heat generating devices. Then, by means of film boiling generated by thermal energy of each of the resistive heat generating devices, liquid is discharged from the discharge opening 5. In this respect, the passage in which Bk ink flows up to its discharge is the same as the one described above, which is symmetrically arranged to it. Here, in FIG. 6, the metallic base 11 is omitted from its representation.

The liquid chamber 8 described above is formed by the ceiling plate 1 and the substrate 4 for use of the resistive heat generating devices. However, a sealant is used to seal and close them completely so as to prevent ink leakage. The sealant is also applied to the TAB connector between the substrate 4 for use of the resistive heat generating devices, and the wiring substage, thus preventing ink from adhering to them for the protection thereof.

The ceiling plate is integrally formed. The image quality enhancement orifice array 23 or the Bk ink orifice array 24, liquid flow path grooves, liquid chamber frame, and liquid induction path 7 are processed by mold formation or laser processing. The image quality enhancement orifice array 23 or Bk ink orifice array 24, and liquid flow path grooves should be processed in high precision.

Also, if the variation is made smaller for the angles of each array in the direction of liquid discharge, the relative positions of liquid shot from each array are not different even when the distance between a recording medium and the image quality enhancement orifice array 23 or the Bk ink orifice array 24 changes. Fundamentally, therefore, there is no need for any electrical correction, which should contribute to making the electrical structure simpler. With this in view, therefore, the processing precision is set at a higher level so as to uniformalize the surface finish of the circumference of the image quality enhancement orifice array 23 or Bk ink orifice array 24, among some others. For these integrally molded products, it is necessary to select the material that may produce not only excellent results in mold formation, but also, present good properties so as not to be easily affected by use of ink. As a specific material, polysulfone is preferable, but other materials may be adoptable.

The substrate 4 for use of the resistive heat generating devices is used for recording by generating film boiling in liquid by the application of thermal energy. On Si substrate, there are formed a plurality of resistive heat generating devices arranged in the form of arrays, and also, Al or other electric wires to supply electric power to these devices, by means of film formation technologies and techniques. Here, in order to make the numbers of TAB pads smaller, shift registers and driving transistors are incorporated on the substrate. It is required to assemble the substrate 4 and the ceiling plate 1 in high precision.

The wiring substrate 2 is to connect electric signals from the printer main body (ink jet recording apparatus) with the substrate 4 described above. One side thereof is connected with the substrate 4 by means of TAB. The other side thereof is provided with connection pads to receive electric signals from the printer main body. The connection pads are fixed to the ceiling plate 1 by adhesive bonding in good precision. Therefore, it is made possible to handle the head as one unit easily. Assembling is easily performed, while the recycling measure is also easily taken. Here, the substrate 4 for use of the resistive heat generating devices is fixed to the ceiling plate 1 by mechanical biasing exerted by the elastic member 3.

FIGS. 7A to 7H are cross-sectional views which illustrate the installation state of the liquid tank 22 and the liquid jet head unit 10 continuously. FIGS. 7A to 7D are cross-sectional views, taken in the direction that connects the two installation screws. FIGS. 7E to 7H are cross-sectional view, taken in the direction orthogonal to the direction that connects the two installation screws.

Figure 7A:
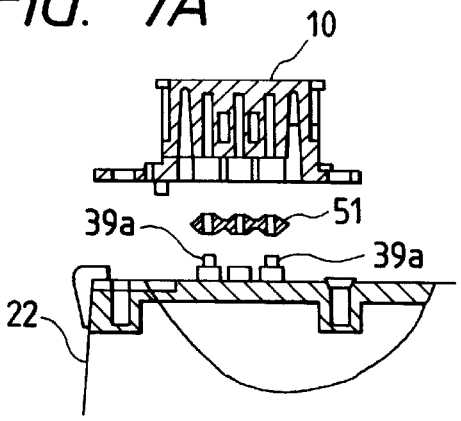
FIGS. 7A, 7B, 7C, 7D, 7E, 7F, 7G and 7H are cross-sectional views which continuously illustrate the states of the liquid tank 22 and the liquid jet head unit 10 being installed.
Figure 7B:
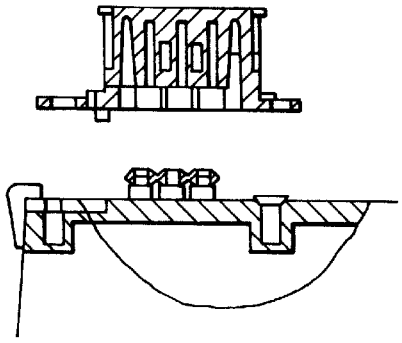
Figure 7C:
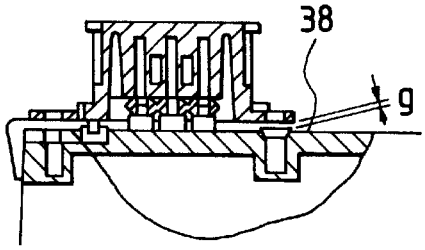
Figure 7D:
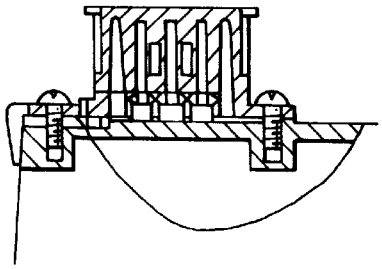
Figure 7E:
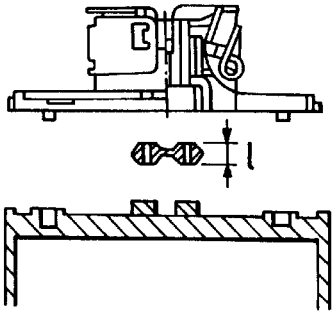
Figure 7F:
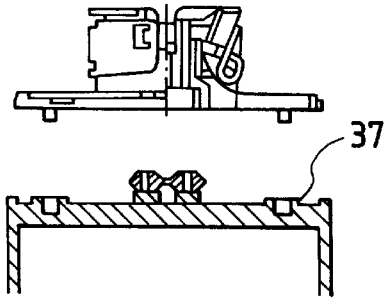
Figure 7G:
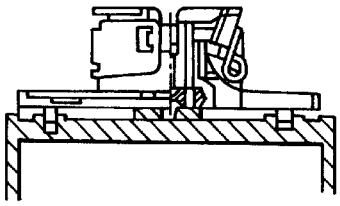
Figure 7H:
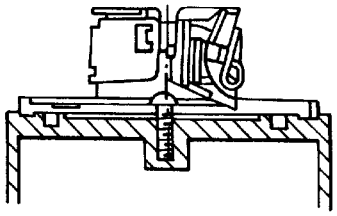

Here, in FIGS. 7E to 7H, the liquid jet head unit is shown partially in section. Of these figures, FIGS. 7E to 7G are cross-sectional views, taken in the position of the supply opening where liquid is actually supplied. On the other hand, FIG. 7H is a cross-sectional view, taken in the position that crosses the installation screw.

For the liquid jet head unit 10, the supply opening is positioned away from the installation surface by a given distance as described above, thus forming the recessed portion as illustrated in FIG. 3. Each of the supply opening groups of the liquid tank 22 is configured to protrude toward the recessed portion, respectively. In this way, the structure is arranged to prevent ink colors from being mixed at the supply opening groups even when attachment and detachment are repeated. However, since the height of the openings are lower than the recessed portion, each of the supply openings faces each other through a space when the liquid tank 22 and the liquid jet heat unit 10 are combined. Therefore, when the liquid tank 22 and the liquid jet head unit 10 are combined, a coupling member (elastic member) 51, which is provided with holes corresponding to each of the supply openings, is arranged to intervene between them.

The height 1 of the coupling member 51 shown in FIG. 7E is set at higher than the distance between each of the supply openings to be coupled. The heights of the mounts 37 and 38 formed for the liquid tank 22 are set so that the compressed portion g of the coupling member 51 can produce its sealing effect sufficiently when the liquid jet head unit 10 is pressed to each of the mounts 37 and 38 (FIG. 7C). In this way, it is attempted to make liquid supply reliably. Further, the mount 37 makes it possible to connect the TAB of the head unit with the electric contacts on the recording apparatus side assuredly when the head cartridge is mounted on the recording apparatus to be described later. At the same time, this mount functions as a receptacle to enable the TAB to receive compression evenly. Also, the positions of the two fixing screws are set so that the line that connects each of the fixing screw positions is substantially in parallel with the longitudinal direction (the direction in which three supply openings are arranged continuously). This is the structure arranged to enhance the connectivity of each of the supply openings. The positions described above are those which are closest possible to the coupling member 51, where forces acts evenly.

Also, the surface of the liquid jet head unit 10 that abuts upon the coupling member 51 in FIG. 6 is in the flat configuration. On the other hands, the dummy supply opening of each supply opening, which is arranged for the liquid tank 22, is provided with the extrusions 39*a* that fit into the holes arranged for the coupling member 51 as shown in FIG. 7A to 7H. Such extrusions function to position the elastic member with respect to the liquid tank. It should be good enough for the elastic member integrally formed with holes corresponding to all the holes of the supply opening groups as in the present embodiment if only at least two of the extrusions are arranged for the supply opening groups among those on the liquid tank side. Of course, it may be possible to arrange such extrusions on the head unit side for positioning the elastic member. In this way, with the coupling member 51 being pinched in, and also, each screw fixation being made at the positions described above, the coupling of each supply opening becomes stabilized.

Also, the supply opening group o f the liquid tank is housed in the recessed portion of the head including the dummy openings as shown in FIG. 3. However, each of the members surrounding the coupling member, which presses the coupling member 51, is provided with sufficiently higher rigidity than that of the coupling member 51. Therefore, these members are not deformed by the elasticity of the coupling member 51. As a result, force is given to the coupling member 51 reliably, hence making it possible to realize the stabilized coupling in accordance with the present embodiment. In addition, the elastic coupling member is in the recessed portion of the head at the time of being coupled as described above. Consequently, the side wall that forms the recessed portion covers its surrounding through a space. Therefore, even if the elastic member is pressed by the coupling surface to move in the direction of the coupling surface, the elastic member is not allowed to be displaced, because it is in the recessed portion which is surrounded by its side wall to enable the supply opening groups to be connected assuredly.

Figure 8:
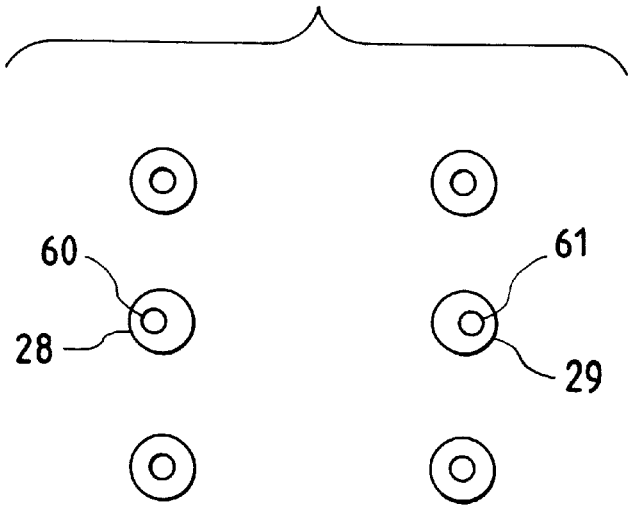
FIG. 8 is a view which shows the holes 60 and 61 being offset from the respective centers of the supply openings. Here, these holes are formed respectively in the Bk ink supply opening 28 of the liquid tank B and the supply opening 29 for image quality enhancement liquid, through which ink and liquid flow conductively.

In accordance with the present embodiment, many kinds of liquid tanks can be installed by use of the coupling member 51 to make the recycling capability and reusability higher. Using the coupling member 51 it is possible to connect a liquid tank and a liquid jet head by modifying the configuration of the coupling member even when the configurations of supply openings and positions of the liquid tank and liquid jet head are different from each other, for example. In FIG. 8, one example is shown, in which the holes 60 and 61 are offset from the respective centers of the supply openings: here, these holes are formed respectively in the Bk ink supply opening 28 of the liquid tank B and the supply opening 29 for image quality enhancement liquid, through which ink and liquid flow conductively. In this way, the coupling member is integrally formed corresponding to the entire supply opening groups, hence making it possible to provide a coupling unit reliably for the head unit and tank without any play.

Figure 9A:
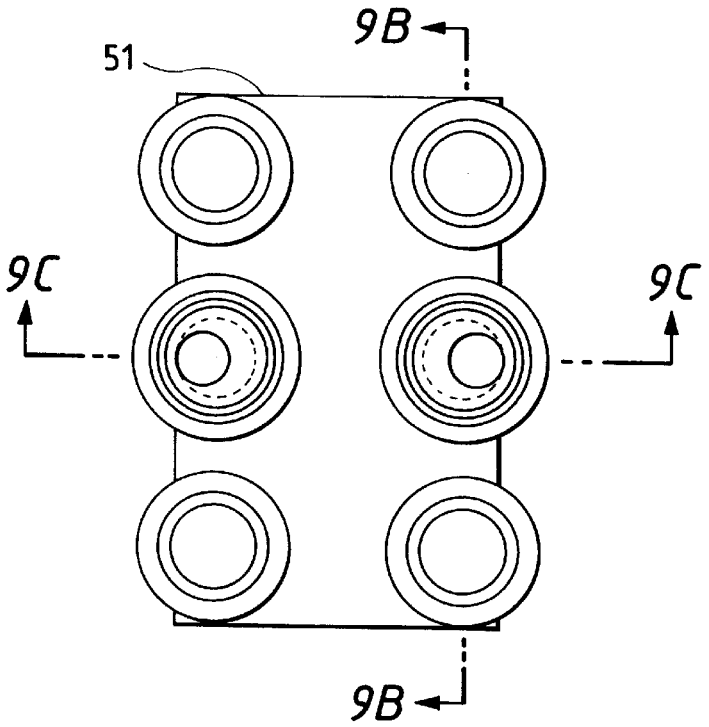
FIGS. 9A, 9B, 9C and 9D are views which illustrate the configuration of a coupling member 51 fit for the liquid tank shown in FIG. 8.
Figure 9B:
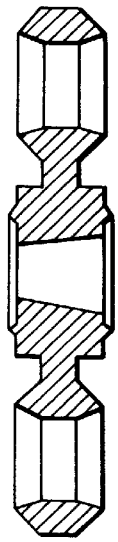
Figure 9C:
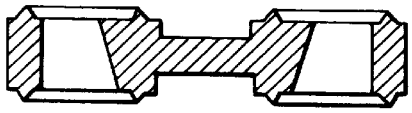

FIGS. 9A to 9D are views which illustrate the configuration of a coupling member 51 fit for the liquid tank shown in FIG. 8; FIG. 9A is a plan view thereof, observed from the side of the installation surface of the liquid tank; FIGS. 9B and 9C are cross-sectional views, taken along line 9B—9B, and line 9C—9C, respectively; and FIG. 9D, a cross-sectional view showing the state immediately before coupling is completed.

Figure 9D:
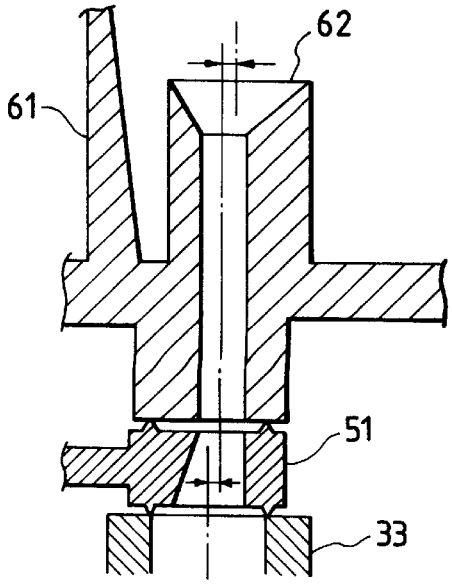

The holes arranged for the coupling member 51 are offset corresponding to the positions of the holes with which each of the former is coupled as shown in each of FIGS. 9A to 9D. FIG. 9D is a cross-sectional view which shows the state where Bk ink is supplied from the ink tank formed by the tank wall 61. Usually, the supply from an ink tank is conducted through a filter 62 as shown in FIG. 9D. In accordance with the example shown in FIG. 9D, the centers of the filter, the supply opening of the ink tank, and the Bk ink supply opening 33 are offset, respectively. Then, the amount of each offset between the center and the respective members is modified by means of the coupling member 51. In addition, the modification of the offset amount by means of the coupling member is smoothly executed in the liquid supply flow paths formed by the two supply opening groups and the coupling member without presence of any stagnation points. Therefore, it becomes possible to suppress the flow resistance of liquid to be supplied to the liquid jet head, and at the same time, to suppress the generation of air bubbles in the liquid supply flow paths.

As described above, even when the diameters and positions of the supply openings on the liquid jet head side and liquid tank side are different, the creation of stagnation and the generation of air bubble in the ink supply paths can be prevented by giving taper to the coupling member 51 itself so that the coupling member 51 is made to form a part of the flow paths itself. The other way around, this means that it may be possible to design the diameters and positions of the holes of the supply openings on the liquid jet head side and the liquid tank side differently for obtaining higher recycling capability and reusability, as well as a greater freedom in making design in this respect. Meanwhile, it may be possible to provide the extrusions fit into the holes arranged for the coupling member 51, which are provided for the dummy supply openings as shown in FIGS. 7A to 7H with respect to all of the respective supply openings. In this case, the length of the holes of the coupling member into which the extrusions are inserted is longer than the height of the extrusions in the released state. Therefore, the installation of the coupling member is reliably made, and the extrusions are squeezed assuredly.

Now, regarding the positioning in accordance with the present embodiment, the regulation is made in the installation direction by means of the positioning extrusion 26 and the recess 32 described above. Here, the positioning extrusion 26 is arranged to protrude toward the interior of the liquid jet head unit 10. As a result, there is no possibility that the Bk ink supply opening 33 and the image quality enhancement liquid supply opening 34 are in contact with each other even when it should be intended to install the unit in the reverse direction, hence presenting an extremely effective function in preventing erroneous installation.

The positioning required for connecting the liquid tank 22 and the liquid jet head unit 10 is made in four points of two positioning mechanism, that is, two threaded holes, and engagement hole 36 and extrusion 35 arranged for the in-plane positioning on the installation surface in order to realize positioning reliably and in high precision. Here, the positioning in the height direction is made by means of mounts 37 and 38.

Also, there is provided the wiring substrate on the left and right sides of each of orifices for making connection with the operational power source and signal lines to be described later. The threaded holes are arranged between them so as to suppress the creation of play even when the attachment and detachment of the carriage are repeated to and from the recording apparatus.

Embodiment 2

Figure 10:
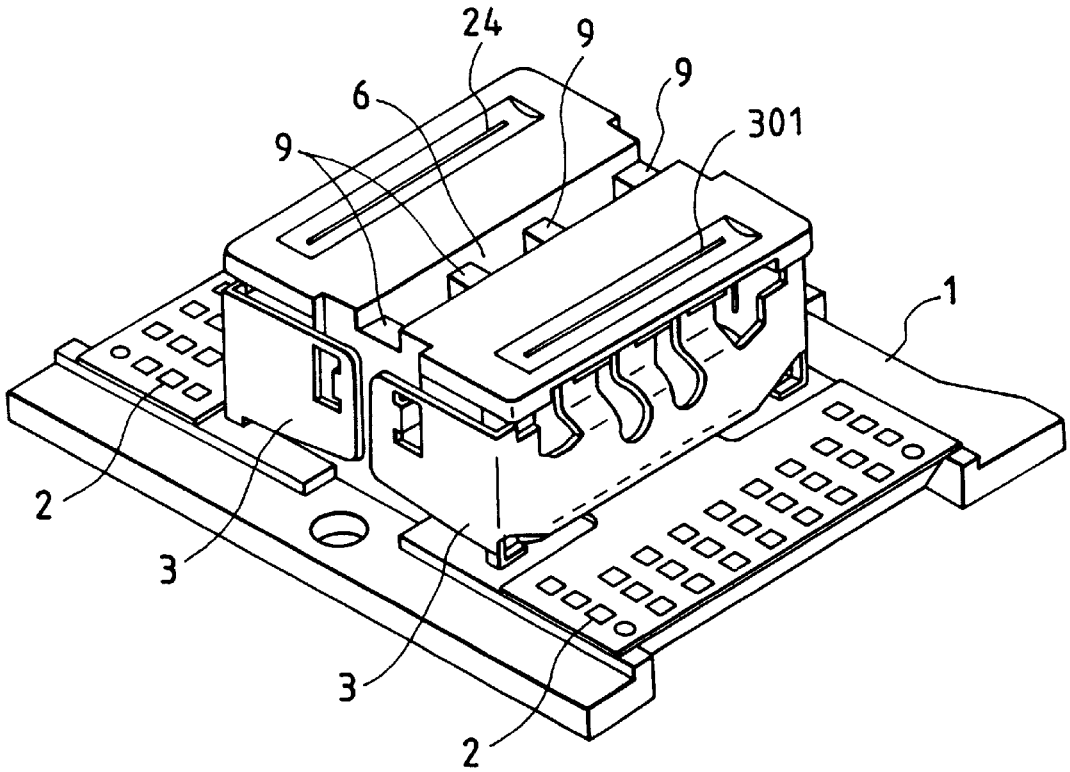
FIG. 10 is a perspective view which schematically shows a liquid jet head unit 300 having the same structure of the liquid jet head unit 10 represented in FIG. 4.

FIG. 10 is a perspective view which schematically shows a liquid jet head unit 300 having the same structure as the liquid jet head unit 10 represented in FIG. 4. The liquid jet head unit 300 is for recording in colors. Instead of the image quality enhancement orifice array 23, a color ink orifice array 301 is installed to discharge ink of three colors (Y, M, and C) from different regions, respectively. Along this arrangement, plural ribs 9 are provided. All the other structures are the same as those of the liquid jet head unit 10. Therefore, while applying the same reference marks appearing in FIG. 4, the description thereof will be omitted.

Figure 11:
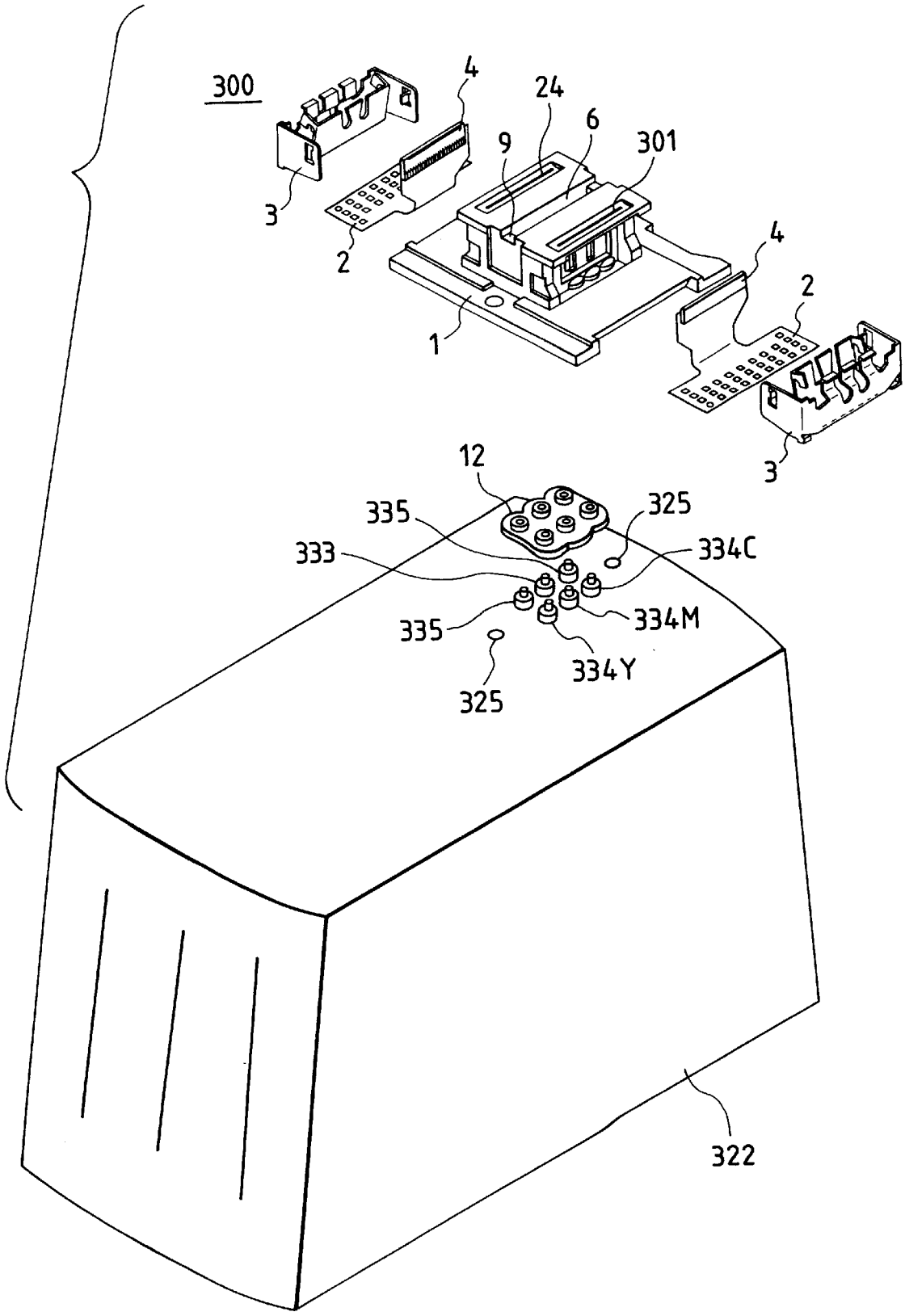
FIG. 11 is a view which illustrates the attachment and detachment mechanism for the ink jet head unit 300 shown in FIG. 10 and a liquid tank.

FIG. 11 is a view which illustrates the attachment and detachment mechanism arranged for the liquid jet head unit 300 structured as described above, and a liquid tank.

The liquid tank 322 houses ink tanks retaining three color (Y, M, and C) ink in addition to Bk ink. For the installation portion of the liquid jet head unit, there are formed the Bk ink supply opening 333 and two extrusions 335, and the ink supply openings 334C, 334M, and 334Y for each of the color ink (Y, M, and C), respectively. Also, for the liquid jet head unit 300, plural supply openings and recessed portions are arranged correspondingly. The attachment and detachment of the liquid jet head unit 300 of the present embodiment are positioned by the same positioning mechanism (not shown) as in the first embodiment described in conjunction with FIG. 1, and screw fixation and others are performed by use of the two threaded holes arranged for the liquid tank 322. For the present embodiment, too, the head unit is fixed to the liquid tank through a coupling member 12 formed by rubber or other elastic material, having holes arranged corresponding to each of the supply openings and the threaded holes. For the present embodiment, an example is shown, in which extrusions are arranged for each of the supply openings of the supply opening group on the tank side, which are inserted into the holes of the coupling member. However, it may be possible to structure a coupling member integrally for use on the head unit side or liquid tank side (head installation member side) by means of two-color formation.

Bk ink retained in the liquid tank 322 is supplied to the liquid jet head unit 300 through the Bk ink supply opening 333, and discharged from the Bk orifice array 24. Each of color ink (Y, M, and C) is supplied to the liquid jet head unit 300 through the ink supply openings 334C, 334M and 334Y, respectively, and discharged from the color ink orifice array 301.

Now, regarding the positions where the Bk ink supply opening 333, two dummy supply openings 335, and each of color ink (Y, M, and C) supply openings 334C, 334M, and 334Y are formed, there are arranged the Bk ink supply opening 333 and the color ink supply opening 334M on the positions which are symmetrical to the line that connects the two threaded holes 325. Also, the two dummy supply openings 335 are provided for the ink supply openings 334C and 334Y so that these openings maintain symmetry to the line that connects the two threaded holes 325. In this manner, pressure exerted by tightening screws is transferred to each of the supply openings to press it down efficiently. When two or more supply openings are formed as in the present embodiment, the supply openings are arranged, having the line that connects two threaded holes located between them, and also, the openings are arranged in the vicinity of such line that connects the two threaded holes. In this way, it is made possible to transfer the pressure efficiently.

Here, the description has been made of the case where six ink supply openings are arranged including the two dummy supply openings 335, but it may be possible to use only three color ink supply openings for effectuating supplies. In this case, it may be possible to arrange a dummy supply opening instead of the Bk ink supply opening 333. Also, it may be possible to arrange only three color ink supply openings. The head used in this case may be the one having the same structure as the present embodiment. Also, one of the orifice arrays may not participate in discharging. By sharing the head unit for use in this manner, it is made possible to standardize parts for common use to materialize the reduction of production costs. Also, using the same ceiling plate, the provision of the TAB, heat generating members, and the like may be omitted for the orifice array that is not used in this case. For an ink tank of the kind, it is possible to increase the ink retaining capacity per kind to the extent that the kinds of liquid to be discharged are reduced. What is important here is that two or more coupling portions are arranged in the arrangement direction of a plurality of supply openings (including the dummy supply openings), and that the supply openings are arranged between these coupling portions.

For the present embodiment, no particular description has been made of the regulation of the installation direction, but as in the first embodiment, the regulation is effectuated by means of the recessed portions arranged for the liquid jet head unit 300 and the positioning extrusions arranged for the liquid tank 322 (neither of them are shown).

In accordance with the present embodiment, the connection between the liquid tank 322 and the liquid jet head unit 300 is positioned by means of two threaded holes and two positioning mechanisms, that is, by four points in total, hence realizing the reliable positioning in high precision.

Embodiment 3

Now, the description will be made of a third embodiment in accordance with the present invention.

In accordance with the embodiments described above, the head is coupled directly with the liquid tank. However, it may be possible to couple them through a head holder. The third embodiment is the one that uses such head holder. For the head holder, there are arranged the supply opening groups for coupling it with the head, and the flow path formation member that forms the flow paths to supply liquid to the supply opening groups. In this manner, the head unit installation member is arranged for the head holder in accordance with the present embodiment.

Figure 12:
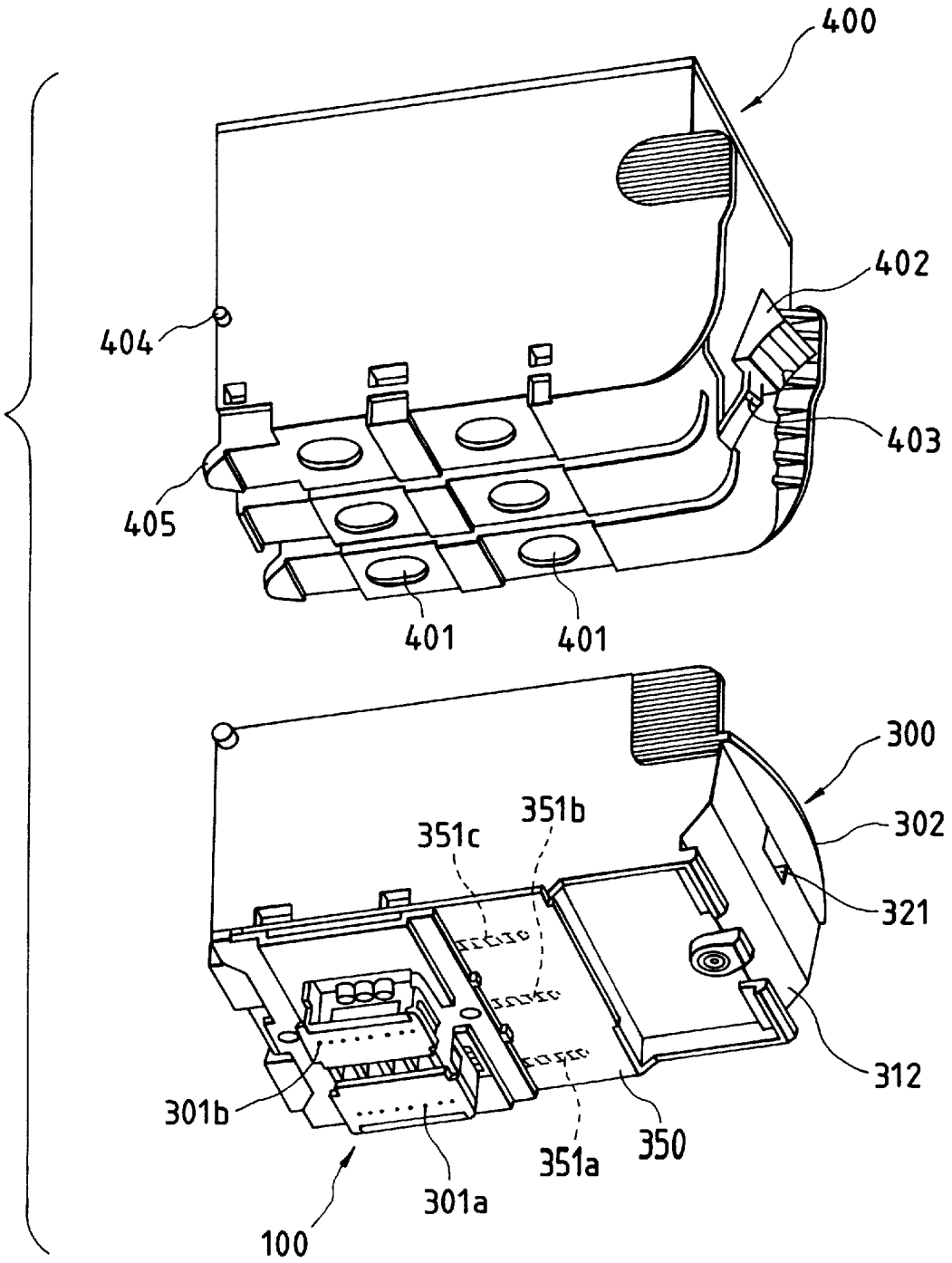
FIG. 12 is a perspective view which illustrates the holder 300 having plural liquid jet head units on the bottom thereof, each being provided with an ink discharge unit, respectively, to constitute an ink jet head of the present invention, and the ink tank 400 to be installed on the holder 300.

FIG. 12 is a perspective view which shows the holder 300 having a plurality of liquid jet head units 100 arranged on the bottom thereof with the respective ink discharge portions, as well as the liquid tank 400 to be installed on the holder 300. By means of the holder 300, the liquid jet head unit and the liquid tank 400 are coupled, at the same time, the liquid tank 400 being held.

The liquid jet unit 100 of the present embodiment is structured to be provided with the two arrays of color ink orifices, each formed as in the second embodiment. One of the arrays 301*a* is arranged to discharge color ink in deeper density, while the other array, color ink in lighter density. Here, darker ink and lighter ink are prevented from being mixed by means of grooves arranged for the supply opening groups of the head even when the attachment and detachment of the head unit are repeated.

On the bottom surface of the holder 300, the flow path formation member 350 is arranged with flow paths 351*a,* 351*b,* 351*c,* and flow paths 351*d,* 351*e,* and 351*f* (not shown). It is preferable to form the flow path formation member 350 with a transparent material so that the state of ink induced into the ink head unit 100 through the flow paths 351*a,* 351*b,* and 351*c,* and also, the bubbles and others mixed in ink can be observed by eyesight in order to detect ink shortage in the liquid tank 400. The present embodiment is structured accordingly. In FIG. 12, it is arranged to be able to observe three color ink flow paths 351*a,* 351*b,* and 351*c* of the six color ink, for example. It is not necessary to observe the entire color ink by eyesight. For example, if only the condition of yellow ink which is used most frequently is made observable by eyesight, the anxiety of the user may be relieved. Also, underneath the flange portion of the holder 300, an engagement hole 321 is arranged to allow the latch nail 403 of the latch lever 402 of the liquid tank 400 to engage therewith. The guide 312 arranged for the flange 302 functions as a second guide to enable the bottom of the liquid tank 400 to abut upon this guide when attaching or detaching the liquid tank 400.

The liquid tank 400 is formed to be installed on the holder 300, and on the bottom thereof, the supply openings 400 are arranged in a number corresponding to the number of liquid jet head unit of the holder 300. Here, six openings are provided for the embodiment described in conjunction with FIG. 12. In the liquid tank 400, dark yellow ink, dark magenta ink, dark cyan ink, light yellow ink, light magenta ink, and light cyan ink are retained separately, for example. Also, on one end of the liquid tank 400, the latch lever 402 and the latch nail 403 are arranged. On the lower part of the opposite end, a plurality of extrusions 405 are arranged. At the same time, a guide extrusion 404 is arranged in the intermediate section on the front of side face.

In order to install such liquid tank 400 on the holder 300, the nail type extrusions 405 of the liquid tank 400 are at first positioned and fitted into the corresponding fall-off prevention holes (not shown) of the holder 300. Then, the latch nail 403 of the latch lever 402 arranged on the opposite side is allowed to engage with the engagement hole 321 of the holder 300. In this way, the both ends of the liquid tank 400 engage with the holder 300 to be held thereby. The liquid tank 400 is thus positioned accurately to enable the liquid tank 400 and the holder 300 are reliably connected to form an integrated body.

Each color ink is retained in the liquid tank 400 in order of cyan (C) ink, magenta (M) ink, and yellow (Y) ink from the front side of FIG. 12. Further, two kinds of ink, dark and light, are prepared for each color ink in order to expand the range of color reproduction, hence making it possible to provide images in high quality having photographic tones. In this case, since the color reproduction on the high light portions is made more often for the image having photographic tones, the consumption of lighter color ink becomes more than that of darker color ink. As a result, if six kinds of ink, each kind of darker and lighter Y, M, and C ink, are retained in one and the same tank, it is necessary to arrange so that each lighter color ink is retained more in it. Here, in FIG. 12, the structure is arranged so that lighter color ink is retained on the right side, while darker color ink on the left side, and each of lighter color ink is arranged to be kept in a quantity two times each of darker color ink.

In this respect, the liquid tank 400 is made capable of retaining plural color ink in it together in order to make the operation of ink replacement easier. For some other modes, the structure is formed so that each of different color ink is retained in each of plural liquid tanks, and then, by use of a mechanism to put them together, these tanks are integrated. The present embodiment may be made applicable to such structure. In such case, only the tank that retains the color ink whose consumption is more frequent can be replaced as needed.

Figure 13A:
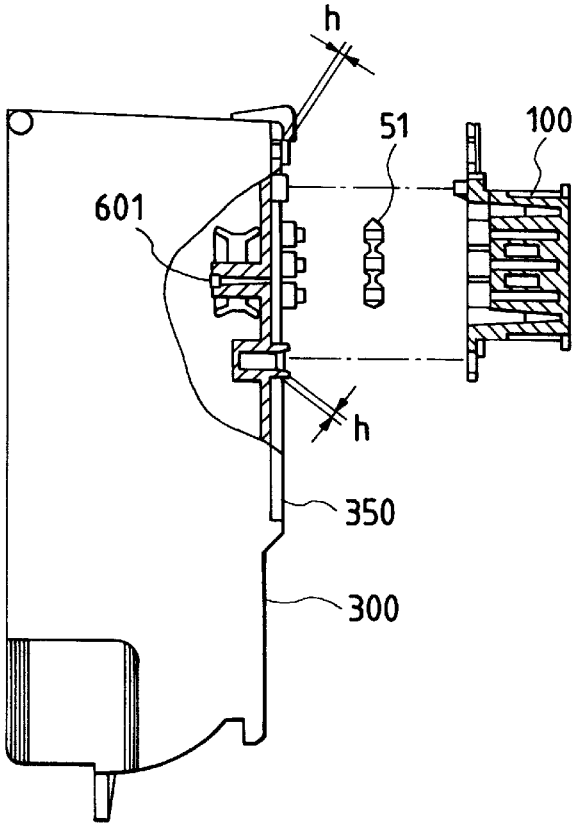
FIG. 13A is a side view which shows the coupling state of the holder 300 and the liquid jet head unit 100.
Figure 13B:
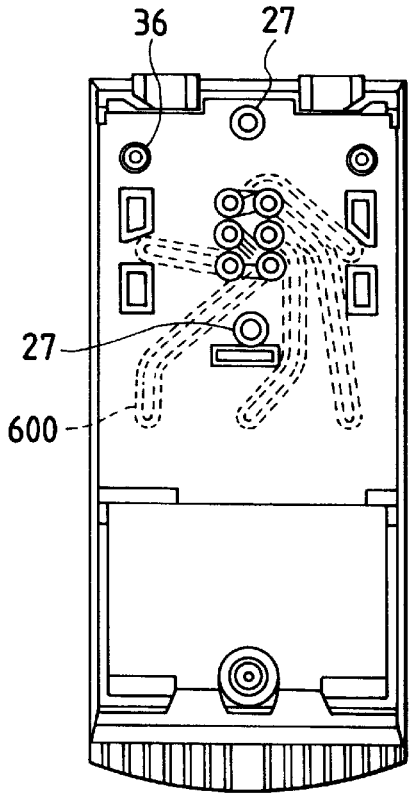
FIG. 13B is a plan view which shows the coupling surface of the holder 300.
Figure 13C:
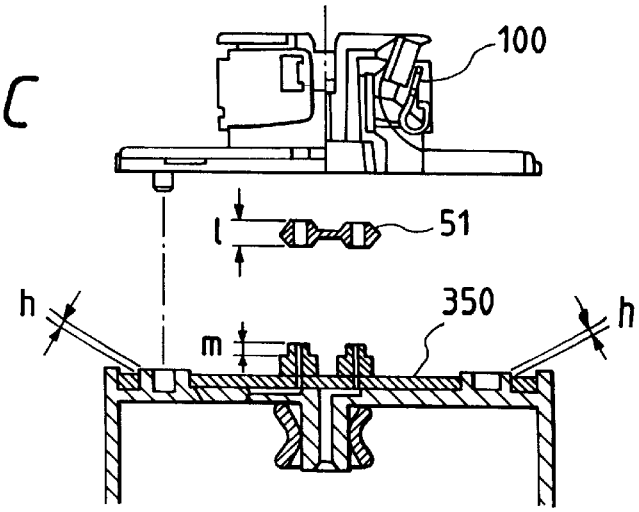
FIG. 13C is a partially sectional front view which shows the coupling state of the holder 300 and the liquid jet head unit 100.

FIG. 13A is a side view which shows the coupling state of the holder 300 and the liquid jet head unit 100. FIG. 13B is a plan view which shows the coupling surface of the holder 300. FIG. 13C is a partially sectional front view which shows the coupling state of the holder 300 and the liquid jet head unit 100. To describe them briefly, the same reference marks applied to the first embodiment are used for the same positions and members shown in FIGS. 13A to 13C which function in the same manner as those in the first embodiment. Here, the description thereof will be omitted.

In accordance with the present embodiment, too, the holder (the tank of the first embodiment) 300 and the liquid jet head unit 100 are coupled through the coupling member 51 as shown in FIGS. 13A and 13C in the same manner as the first embodiment. Here, also, as in the second embodiment, each of the supply openings on the holder side (head installation member side) of the present embodiment is arranged in extrusion fitted into each of the holes arranged for the coupling member. The length 1 of each hole in the released state of the coupling member is made longer than the height m of the extrusion. In this manner, not only the installation of the coupling member is reliably made, but also, the extrusion is squeezed assuredly in the same manner as the second embodiment. The ink flow path from the ink tank that retains ink to the liquid jet head 100 is formed by the induction tube 601; the flow path 600 formed by the flow path formation member 350 and the holder 300; and also, by the coupling member 51. The installation of the liquid jet head unit 100 is made by means of positioning by use of the engagement hole 36, and screw fixation using threaded hole 27. However, these means are arranged for the holder 300 itself, at the same time, being formed to extrude from the flow path formation member 350. The height of extrusion of the threaded hole 27 and that of the engagement hole 36 are the same and are defined as h. This height h intervenes with the screw fixation of the liquid jet head unit 100 to provide a gap between the head unit and the holder 300. Also, with the mount 37, this gap functions to reliably receive the TAB that constitutes the liquid jet head unit 100.

As described above, the flow path formation member 350 is provided for the holder 300. However, in order not to allow the flow path formation member 350 to intervene with the coupling of the liquid jet head unit 100 and the holder 300, it is structured to connect the threaded hole 27 and engagement hole 36 arranged for the holder 300, which become the coupling surface, with the liquid jet head unit 100 directly without any intervention of the flow path formation member 350. As a result, it is possible to assemble the flow path formation member 250 in high precision independently, because this member does not participate directly in coupling the head unit and holder.

Other Embodiments

Hereinafter, the description will be made of the embodiment applicable to each of the embodiments described above.

Here, also, with reference to FIG. 18 to FIG. 22, the description will be made of the other embodiments applicable to each of the embodiments described above.

At first, a supplementary explanation will be made of the recording head unit which is preferably applicable to the coupling modes of the present invention.

The fundamental structure of the ink jet recording head to which the present invention is applicable, and the constituent thereof will be described partly including the repetition of some description that has already been made.

The present embodiment is an ink jet head unit of an ink tank and an ink jet recording head being arranged to be detachably mountable on a carriage, and the following four main functional units are arranged to cover various aspects of the recording head:

(a) The unit that receives electric signals from the apparatus main body side (hereinafter referred to as an "electrical coupling unit")

(b) The unit that receives ink from the ink tank (hereinafter referred to as an "ink supply unit")

(c) The unit that discharges ink (hereinafter referred to as an "ink discharge unit")

(d) The unit that positions the ink jet recording head with respect to the carriage (hereinafter referred to as a "positioning unit")

Also, it is preferable to take into consideration the following conditions, because when these four main functional units are structured, it is required to obtain the reliability of the ink jet recording head and the quality of recorded images, as well as the ease with which the ink jet recording heads and ink tanks can be replaced:

(1) If the ink supply unit described above should be arranged on the same surface as the one on which the ink discharge unit is arranged or the electrical coupling unit described above should be arranged together, there is a possibility that mist of ink discharged from the ink discharge unit for recording is caused to scatter onto the electrical coupling unit, and then, short circuit may take place due to the conduction through the ink mist or since the distance between a recording material and the electrical coupling unit is close, paper fluffs or other dust particles may adhere to the electrical coupling unit. Hence, malfunction may occur on the electrical contact.

(2) When ink jet recording heads are exchanged or the separated ink tanks are replaced, the attaching or detaching force exerted by such exchange or replacement is given to the carriage, and ink jet recording head as well. If the ink jet recording head should shift by such load as this, it becomes difficult to obtain the position of the ink jet recording head exactly as desired. Consequently, the exact shooting positions of ink for recording cannot be secured, leading to the degradation of the quality of recorded images.

(3) In the processes of manufacture, it is required to assemble each of the ink jet recording heads precisely for use of color recording so as to maintain the high precision in which each of them is positioned.

Figure 14:
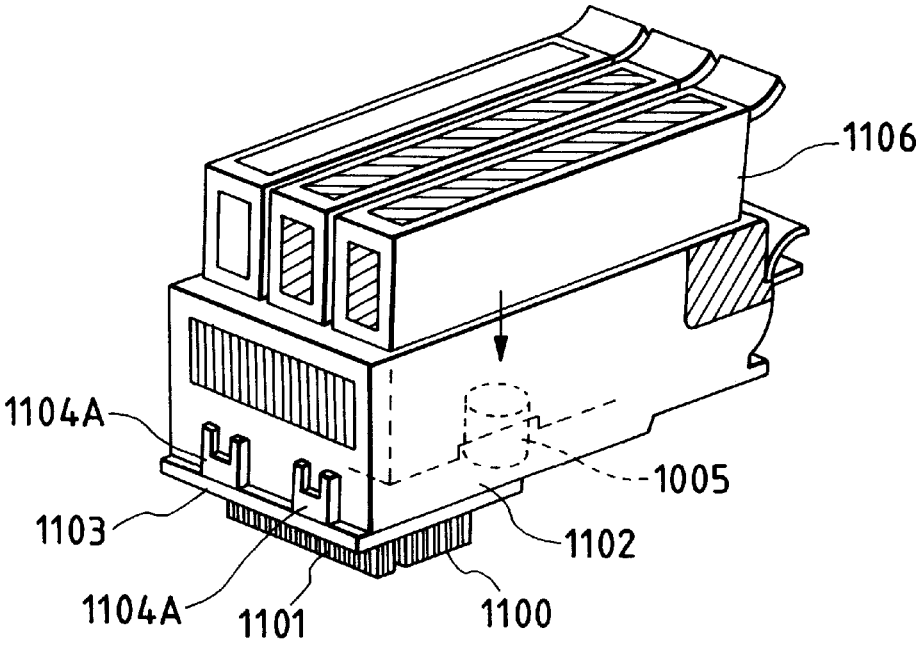
FIG. 14 is a perspective view which shows the outer appearance of another embodiment in accordance with the present invention.

FIG. 14 is a view which shows one example of the structure of an ink jet recording head and ink tank embodying the present invention in consideration of each of conditions referred to in the above paragraphs (1) to (3).

In FIG. 14, a reference numeral 1100 designates an ink jet recording head having the same structure as those described in each of the embodiments described earlier; 1101, 1102, and 1103, the ink discharge unit, holder, and electrical coupling unit of the ink jet recording head 1100, respectively. Also, a reference numeral 1106 designates an ink tank. The ink supply is effectuated when the ink tank is connected with an ink supply tube 1105 arranged in the ink discharging direction, that is, in the direction perpendicular to the surface of electric contact, in the holder 1102 fixed to the ink jet recording head 1100.

Figure 15:
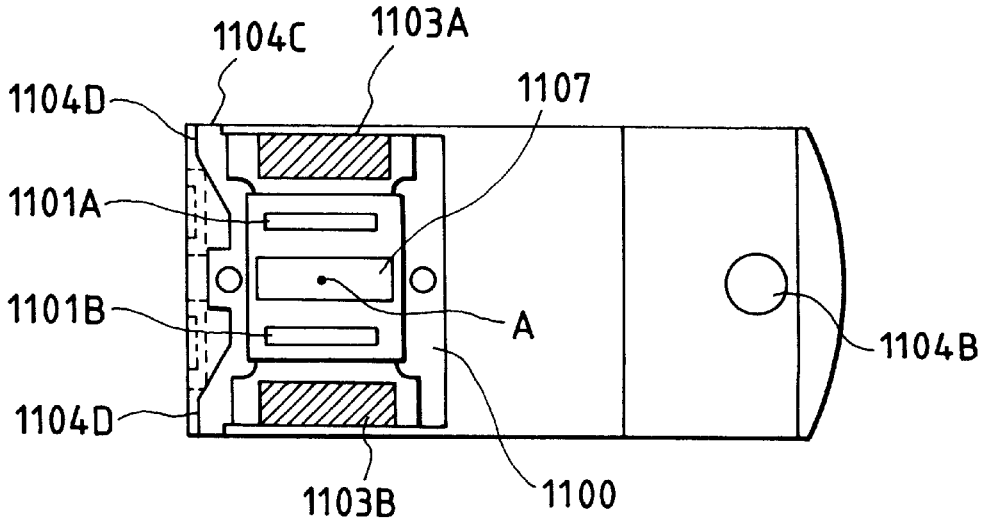
FIG. 15 is a structural view of FIG. 14, observed from the side in the ink discharging direction.

FIG. 15 is a structural view of the ink jet unit shown in FIG. 14, observed from the ink discharging direction side. The ink discharge unit 1101 and the electrical coupling unit 1103 described above are in the state where these units are arranged at 1101A, 1101B; and 1103A, 1103B centering around the point at A. Here, reference numerals 1104C and 1104D designate the positioning portions at the respective corners of the ink jet recording head 1100 in order to position the ink jet recording head 1100 in the directions X and Y with respect to the main body (not shown). Also, in the direction Z, the positioning thereof is executed at 1104B and 1104A. In this respect, the groove 1107 is formed between the aforesaid ink discharge units 1101A and 1101B. The length of the groove is longer than that of each ink discharge unit.

Also, in accordance with the embodiments of the present invention shown in FIG. 4 and FIG. 10, each of the constituents of the recording head described above is arranged for the recording head to satisfy the condition given below.

In other words, the ink discharge surface is not formed on the same surface on which the ink supply and electrical contact are made. Then, it is made possible to prevent mist of ink for recording from being scattered onto the electrical contact unit when ink is discharged from the ink discharge unit. Therefore, the short circuit is prevented from taking place due to the conduction through ink mist thus produced. Also, in this way, the distance between the recording material and the electrical contact unit is made longer, paper fluffs and dust particles are prevented from adhering to the electrical contact surface that may bring about malfunction of the electrical contact.

Particularly, in accordance with the present embodiment, the electric contact surface is arranged ±5 degrees in the direction perpendicular to the direction of ink discharge, and the ink discharge surface is arranged to extrude 5 mm or more from the electric contact surface. Also, this stepped portion is utilized for the electrical coupling unit of the carriage of the printer main body. Therefore, it is possible to obtain the effect that may be produced by this unit that functions as if a preventive wall against the ink mist and the paper fluffs.

Further, if two ink discharge units are arranged in order to record in colors, the first array of the ink discharge unit and the electric contact surface therefor, and the second array of the ink discharge unit and the electric contact surface therefor are arranged in the positions rotated 180 degrees around the center of the two arrays as its rotational center. In this manner, the shareable use of parts is made possible, leading to the reduction of costs.

Also, with the provision of a groove between the two arrays of ink discharge units, it is made possible to prevent ink from being mixed when different colors of ink are discharged from each of the ink discharge units.

Then, the ink supply unit, such as separated ink tanks, is coupled by being pressed in the direction of ink discharge, it is made possible to prevent the displacement of head that affects recording in colors by evenly receiving the load, which may be exerted on the head at the time of attaching and detaching ink tanks, on the left and right sides on the outer sides of the ink head arrays.

Figure 16A:
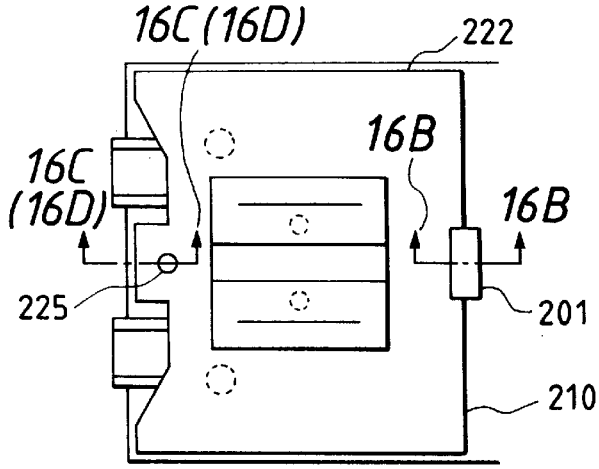
FIGS. 16A, 16B, 16C, 16D, 16E, 16F and 16G are views which illustrate the structure of another embodiment in accordance with the present invention.

Now, the description will be made of the embodiment that illustrates the structure thereof whereby it is attempted to make the operation easier to install the liquid jet head unit on the liquid tank. FIGS. 16A to 16G are cross-sectional views which illustrate the structure of the embodiment. FIG. 16A is a plan view which shows the state of installation. Here, whereas each of the embodiments described above uses two screws for installation, the present embodiment uses a hook so that the screw fixation is made only in one position.

Figure 16B:
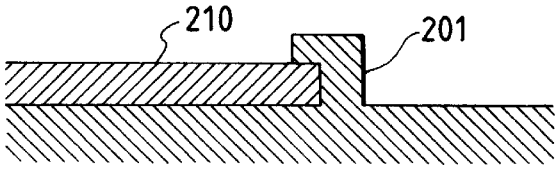

For the liquid tank 222 of the present embodiment, the hook 201 is arranged to hook the liquid jet head unit 210 to be installed in the vicinity of the location where one of the two threaded holes is provided for each of the embodiments described above. The hook 201 is folded toward the inside of the surface of the liquid jet head unit 210 as shown in FIG. 16B which is a cross-sectional view, taken along line 16B—16B in FIG. 16A. When the liquid jet head unit 210 is installed, it is brought to the state that the liquid jet head unit 210 abuts upon the hook 201. After that, the screw fixation is made through the threaded hole 225.

In accordance with the present embodiment, the liquid tank 222 and the liquid jet head unit 210 are positioned for coupling by three points, that is, one threaded hole, and two positioning mechanisms. As a result, it is possible to realize the reliable and highly precise portioning as in the first embodiment.

The directional regulation of the positioning, and the transfer of pressure to the Bk ink supply opening and the image quality enhancement liquid of the present embodiment are the same as those of the first embodiment, hence making it possible to supply the respective liquids assuredly.

Figure 16C:
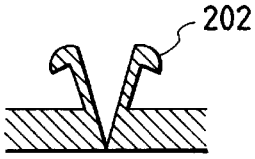
Figure 16F:
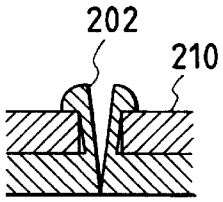
Figure 16D:
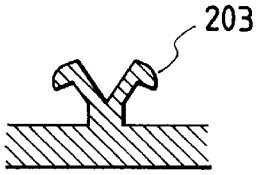
Figure 16G:
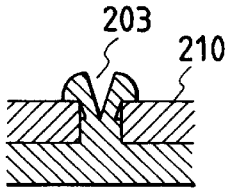
Figure 16E:
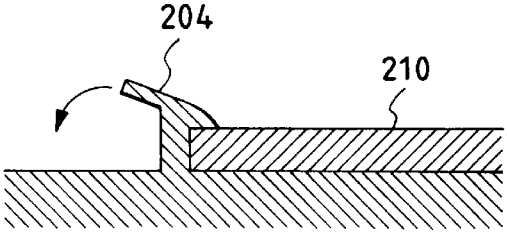

FIGS. 16C to 16E are views which illustrate the principle structures of embodiments whereby to attempt simpler installation of the liquid jet head unit, respectively.

For each of these embodiments, deformable resin boss or click adhesively bonded or welded to the liquid tank 222 instead of the screw fixation used for the embodiment represented in FIG. 16A.

FIG. 16C and FIG. 16D are cross-sectional views, taken along line 16C(16D)—16C(16D) in FIG. 16A. The embodiments shown in these figures use a boss 202 whose cut off portion reaches the bottom surface of the liquid tank, and a boss 203 whose cut off portion is made only half way, respectively. FIG. 16F and FIG. 16G illustrate the state where these bosses are in use, respectively.

With respect to each of the embodiments shown in FIGS. 16C and 16D, the liquid jet head unit 210 is allowed to abut upon the hook 201 when the liquid jet head unit 210 is installed. Then, the liquid jet head unit 210 is pressed to the liquid tank 222 until the boss 202 or boss 203 appears through the threaded hole 225. In this way, the installation is made by such a series of simple operations.

For each of the embodiments shown in FIGS. 16C and 16D, the liquid tank 222 and the liquid jet head unit 210 are positioned for coupling by three points, that is, one threaded hole, and two positioning mechanisms. As a result, it is possible to realize the reliable and highly precise portioning as in the first embodiment. The directional regulation of the positioning, and the transfer of pressure to the Bk ink supply opening and the image quality enhancement liquid of the present embodiment are the same as those of the first embodiment, hence making it possible to supply the respective liquids assuredly.

The embodiment shown in FIG. 16E is such that a click 204 is used to press down the side opposite to the hook 201. For the embodiment shown in FIG. 16E, the liquid jet head unit 210 is brought to the state where it is abut upon the hook 201 when the liquid jet head unit 210 is installed. Then, the liquid jet head unit 210 is pressed down to the liquid tank 222 until it is held down by the click 204. With such a series of simple operations, the unit is installed. Also, when it is removed, the click 204 is pressed in the direction indicated by an arrow in FIG. 16E. Hence, the attachment and detachment thereof are easily performed.

For the embodiments shown in FIG. 16E, the liquid tank 222 and the liquid jet head unit 210 are positioned for coupling by two points of the positioning mechanism. As a result, it is possible to realize the reliable and highly precise portioning as in the first embodiment. The directional regulation of the positioning, and the transfer of pressure to the Bk ink supply opening and the image quality enhancement liquid of the present embodiment are the same as those of the first embodiment, hence making it possible to supply the respective liquids assuredly.

In this respect, any one of the embodiments described above is not necessarily limited to the combination of the screw fixation or the hooking fixation. It is of course possible to adopt any arbitrary combinations. For example, it may be possible to adopt an attachment and detachment mechanism using the boss shown in FIG. 16C and FIG. 16D and the click shown in FIG. 16E.

Also, although not shown, the threaded hole may be made a press-in hole, and using a press-in pin to effectuate the coupling. Further, for a simple coupling, it may be possible to adopt such coupling unit in combination with a boding agent or simple use a bonding agent alone individually. When using a bonding agent, it is preferable to fix the coupling unit in high precision by provisionally holding it down before applying the bonding agent for the reliable fixation.

Figure 17:
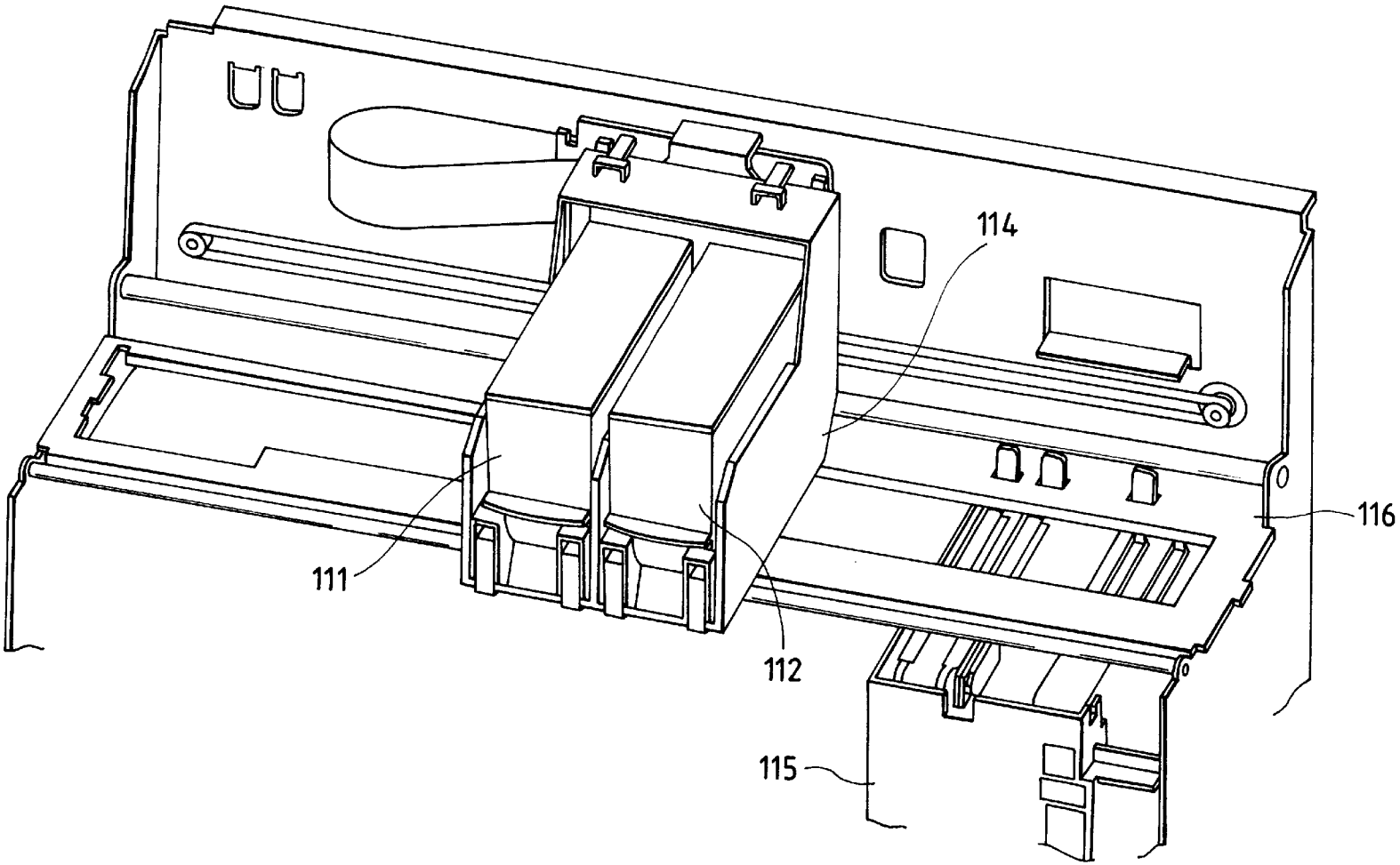
FIG. 17 is a perspective view which shows the outer appearance of one example of the liquid jet recording apparatus (IJRA) having the liquid jet head cartridge (IJC) obtainable by the present invention mounted on it.

Lastly, the description will be made of the liquid jet recording apparatus of the present invention. FIG. 17 is a perspective view which shows the outer appearance of one example of a liquid jet recording apparatus (IJRA) having a liquid jet head cartridge (IJC) obtained by means of the present invention mounted on it.

In FIG. 17, a reference numeral 114 designates a carriage on which a recording head is mounted; 115, a head recovery unit having incorporated in it the head cap arranged to prevent a plurality of orifices formed on the leading end of the head to discharge ink from being dried, as well as a suction pump to suck ink from the plural orifices when the operation of head becomes defective. Here, a reference numeral 116 designate the surface where a recording sheet is being carried.

The cartridge 111 integrally formed with the Bk head tank and the color ink cartridge 112 are mounted on the carriage 114 side by side on one line. The position on the recovery unit 115 is defined as the home position of the carriage 114, and printing begins when the carriage starts to scan in the left-hand direction in FIG. 17.

Since the present invention is structured as described above, the following effect is obtainable:

It is possible to materialize stabilized recording on a recording medium by means of stabilized supply of ink, while preventing any erroneous installation in the coupling mode.

Also, with respect to a head having a plurality of orifice arrays, it is possible to maintain the surface of discharge openings at a constant position even when the head is detachably mounted on the apparatus repeatedly, hence performing stabilized recording on a recording medium.

Further, it is possible to transfer pressure exerted by the installation member to the supply openings efficiently. As a result, leakage and solidification of liquid rarely take place, hence enhancing the reliability of the apparatus.

What is claimed is:

1. A method for coupling a liquid jet head unit for recording by discharging liquid to a recording medium with a head installation member for installing said head unit using an elastic member, comprising the following steps:

preparing liquid jet head unit constructed integrally with two substantially parallel orifice arrays and a first supply opening group for supplying a liquid to said orifice arrays, and said head installation member having a second supply opening group corresponding to said first supply opening group for supplying the liquid to said liquid jet head unit, and also, said elastic member having holes corresponding to each of said supply opening groups;

providing first and second coupling units for, respectively, one end side and an other end side of said two orifice arrays for coupling said liquid jet head unit and said head installation member; and coupling only one face of said liquid jet head unit and said head installation member using said first and second coupling units.

2. A method for coupling a liquid jet head unit according to claim 1, further comprising the step of arranging said first and said second coupling units on a line passing between said two orifice arrays.

3. A method for coupling a liquid jet head unit according to claim 1, further comprising the step of arranging said first and said second coupling units on a line running substantially parallel to said two orifice arrays.

4. A method for coupling a liquid jet head unit according to claim 1, further comprising the step of arranging each of said first and said second supply opening groups for each of said orifice arrays in two lines which are substantially symmetrical between said two orifice arrays when observed from an installation surface.

5. A method for coupling a liquid jet head unit according to claim 4, further comprising the step of arranging said first and said second coupling units on a line extending past said two lines of said supply opening groups.

6. A method for coupling a liquid jet head unit according to claim 4, further comprising the step of arranging said first and said second coupling units on a line running substantially parallel to said two lines of said supply opening groups.

7. A method for coupling a liquid jet head unit according to claim 4, are arranged on at least one of two intersecting lines which intersect between the two orifice arrays.

8. A method for coupling a liquid jet head unit according to claim 1, further comprising the steps of:

forming portions of a plurality of liquid supply flow paths in said elastic member; and coupling said elastic member to be in contact with the liquid to be supplied.

9. A method for coupling a liquid jet head unit according to claim 1, further comprising the step of providing at least one of the supply opening groups with means for positioning said elastic member.

10. A method for coupling a liquid jet head unit according to claim 1, further comprising the step of providing at least one of the supply opening groups with means for covering the circumference of said elastic member through a space.

11. A method for coupling a liquid jet head unit according to claim 1, further comprising the step of using an elastic sheet having integral holes corresponding to said first and second supply opening groups as said elastic member.

12. A method for coupling a liquid jet head unit according to claim 1, wherein said coupling is effected using a coupling means that can be disassembled.

13. A liquid jet head unit for use in a method for coupling a liquid jet head unit according to claim 1, wherein a substrate having resistive heat generating devices formed thereon to discharge ink individually corresponding to at least one of said two orifice arrays is, when adhesively bonded to aa metallic base, pressed to be fixed to a ceiling plate having a plurality of ink flow path grooves, ink chambers, and ink induction paths formed thereon and a plurality of orifice arrays are arranged in two substantially parallel arrays, and a circumference thereof is airtightly closed by sealant to form ink flow paths and ink chambers, while a flexible wiring substrate having connection with a carriage side is connected with said substrate, and said wiring substrate is fixed to said metallic base and said ceiling plate.

14. A liquid jet head cartridge having components coupled through an elastic member, comprising:

a liquid container for retaining a liquid;

a liquid jet head unit for recording by discharging said liquid to a recording medium; and a head installation member for installing said head unit, said liquid jet head unit having two substantially parallel orifice arrays and a first supply opening group for supplying liquid to said orifice arrays, said head installation member being provided with a second supply opening group corresponding to said first supply opening group for supplying liquid to said liquid jet head unit, said elastic member having holes corresponding to both said first and said second supply opening groups, and the first and second coupling units being provided for two end sides of said two orifice arrays for coupling said liquid jet head unit and said head installation member, respectively, and only one face of said liquid jet head unit and said head installation member is coupled by said first and second coupling units.

15. A liquid jet head cartridge according to claim 14, wherein said first and second coupling units are arranged on a line running along said two orifice arrays.

16. A liquid jet head cartridge according to claim 13, wherein said first and said second coupling units are arranged on a line running substantially parallel to said two orifice arrays.

17. A liquid jet head cartridge according to claim 14, wherein respective said supply opening groups for said orifice arrays are arranged in two lines substantially symmetrically disposed between said two orifice arrays when observed from an installation surface.

18. A liquid jet head cartridge according to claim 17, wherein said first and said second coupling units are arranged on a line passing between said two orifice arrays.

19. A liquid jet head cartridge according to claim 17, wherein said first and said second coupling units are arranged on a line running substantially parallel to said two orifice arrays.

20. A liquid jet head cartridge according to claim 17, wherein the first and second coupling units are arranged on at least one of two intersecting lines which intersect between the two orifice arrays.

21. A liquid jet head cartridge according to claim 13, wherein said liquid supply flow paths are partly formed by said elastic member, and said elastic member is in contact with the liquid to be supplied.

22. A liquid jet heat cartridge according to claim 13, wherein said surface of at least one of said first and said second supply opening groups abutting said elastic member is flat, and at least two of the other supply opening groups are extrusions that are inserted into the holes formed in said elastic member.

23. A liquid jet head cartridge according to claim 13, wherein at least one of said first and said second supply opening groups is provided with a side wall covering a circumference of said elastic member through a space.

24. A liquid jet head cartridge according to claim 13, wherein said elastic member has integral holes corresponding to said first and said second supply opening groups.

25. A liquid jet head cartridge according to claim 14, wherein at least one said coupling unit is coupled by coupling means that can be disassembled.

26. A liquid jet head cartridge according to claim 13, wherein a positioning mechanism is arranged an installation surface of said liquid jet head unit and said head installation member.

27. A liquid jet head cartridge according to claim 26, wherein said positioning mechanism also prevents erroneous installation with respect to a direction of installation.

28. A liquid jet head cartridge according to claim 14, wherein at least one of said orifice arrays discharges a processing liquid for image quality enhancement, and the other said orifice array discharges an ink.

29. A liquid jet head cartridge according to claim 28, wherein a groove is arranged between the supply opening which supplies the processing liquid to said first supply opening groups and the supply opening which supplies the ink to said second supply opening groups.

30. A liquid jet head cartridge according to claim 14, wherein one array of said orifice arrays discharges an ink having a darker density, and the other array discharges an ink having a lighter density.

31. A liquid jet head cartridge according to claim 14, wherein one array of said orifice array is a dummy orifice array which does not discharge the liquid.

32. A liquid head cartridge according to claim 14, wherein said supply opening groups include the supply openings which supply the liquid and the dummy supply openings which do not supply the liquid.

33. A liquid jet head cartridge according to claim 14, wherein said liquid container and said head installation member are integrally constructed.

34. A liquid jet head cartridge according to claim 14, wherein said liquid container is part of an ink tank and said head installation member is part of a head holder, and said ink tank and said head holder are seperable.

35. A liquid jet head cartridge according to claim 34, wherein a flow path formation member having a plurality of ink flow paths and said second supply opening group is provided at a bottom of said head holder, and said first and second coupling units protrude equally from said flow paths formation member.

* * * * *

UNITED STATES PATENT AND TRADEMARK OFFICE

CERTIFICATE OF CORRECTION

PATENT NO. : 6,293,652 B1
DATED : September 25, 2001
INVENTOR(S) : Teruo Arashima et al.

It is certified that error appears in the above-identified patent and that said Letters Patent is hereby corrected as shown below:

Column 4,
Line 48, "is" should be deleted.

Column 5,
Line 2, "serves" should read -- serve --.

Column 6,
Line 11, "7H," should read -- 7H are --; and "view" should read -- views --.

Column 7,
Line 60, "axial symmetry" should read -- axial symmetric --.

Column 10,
Line 11, "wringing" should read -- wiring --.

Column 12,
Line 6, "heat" should read -- head --.

Column 21,
Line 14, "is abut" should read -- abuts --;
Line 40, "boding" should read -- bonding --; and
Line 41, "simple" should read -- simply --.

Column 22,
Line 56, "claim 4," should read -- claim 4, wherein --; and "are arranged" should read -- the first and second coupling units are arranged --.

Column 23,
Line 22, "connection" should read -- connection pads thereon for making electrical connection --;
Line 36, "said" should read -- a --;
Line 49, "and" should read -- and said --; and "along" should read -- substantially parallel to --;
Line 50, "claim 13," should read -- claim 14, --; and
Line 52, "running substantially parallel" should read -- passing between --.

UNITED STATES PATENT AND TRADEMARK OFFICE

CERTIFICATE OF CORRECTION

PATENT NO. : 6,293,652 B1
DATED : September 25, 2001
INVENTOR(S) : Teruo Arashima et al.

It is certified that error appears in the above-identified patent and that said Letters Patent is hereby corrected as shown below:

Column 24,
Line 5, "claim 13," should read -- claim 14, --;
Line 9, "heat" should read -- head --; and "claim 13" should read -- claim 14, --;
Line 15, "claim 13," should read -- claim 14, --;
Line 19, "claim 13," should read -- claim 14, --;
Line 23, "at least one" should be deleted;
Line 25, "claim 13," should read -- claim 14, --; and "an" should read -- for an --;
Line 46, "array is" should read -- arrays is --; and
Line 62, "paths" should read -- path --.

Signed and Sealed this

Fourteenth Day of May, 2002

*Attest:*

*Attesting Officer*

JAMES E. ROGAN
*Director of the United States Patent and Trademark Office*